US008091686B2

(12) United States Patent
Ito

(10) Patent No.: US 8,091,686 B2
(45) Date of Patent: Jan. 10, 2012

(54) MAGNETIC GUIDE APPARATUS

(75) Inventor: Hiroaki Ito, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 567 days.

(21) Appl. No.: 12/347,037

(22) Filed: Dec. 31, 2008

(65) Prior Publication Data

US 2009/0173583 A1 Jul. 9, 2009

(30) Foreign Application Priority Data

Jan. 4, 2008 (JP) ..... 2008-000144

(51) Int. Cl.
*B66B 1/34* (2006.01)

(52) U.S. Cl. ..... 187/292; 187/393; 187/409

(58) Field of Classification Search ..... 187/277, 187/289, 292, 293, 296, 297, 391–393, 401, 187/409, 410; 318/799–815, 600, 609, 610, 318/611, 623
See application file for complete search history.

(56) References Cited

U.S. PATENT DOCUMENTS

| | | | | |
|---|---|---|---|---|
| 5,304,751 | A * | 4/1994 | Skalski et al. | 187/393 |
| 5,477,788 | A * | 12/1995 | Morishita | 104/284 |
| 5,652,414 | A | 7/1997 | Roberts et al. | |
| 5,749,444 | A | 5/1998 | Skalski | |
| 5,814,774 | A | 9/1998 | Remmers et al. | |
| 5,866,861 | A | 2/1999 | Rajamani et al. | |
| 5,955,709 | A | 9/1999 | Traktovenko et al. | |
| 6,338,396 | B1 * | 1/2002 | Morishita | 187/292 |
| 6,401,872 | B1 | 6/2002 | Morishita | |
| 6,408,987 | B2 * | 6/2002 | Morishita | 187/292 |
| 7,014,013 | B2 * | 3/2006 | Fujita | 187/292 |
| 7,793,760 | B2 * | 9/2010 | Ito et al. | 187/292 |
| 7,841,451 | B2 * | 11/2010 | Ito | 187/292 |
| 7,929,268 | B2 * | 4/2011 | Morishita | 361/144 |
| 8,002,086 | B2 * | 8/2011 | Ito | 187/292 |
| 2008/0257655 | A1 * | 10/2008 | Ito et al. | 187/406 |
| 2011/0056773 | A1 * | 3/2011 | Ito | 187/393 |
| 2011/0162914 | A1 * | 7/2011 | Ito et al. | 187/409 |

FOREIGN PATENT DOCUMENTS

| | | | |
|---|---|---|---|
| CN | 101 475 113 | A | 7/2009 |
| JP | 5-178563 | A | 7/1993 |
| JP | 05178562 | A * | 7/1993 |
| JP | 11-071067 | A | 3/1999 |
| JP | 2001-019286 | A | 1/2001 |
| JP | 2005-350267 | A | 12/2005 |

OTHER PUBLICATIONS

H. Ito, U.S. PTO Notice of Allowance, U.S. Appl. No. 12/200,114; dated Apr. 26, 2011, 10 pages.

* cited by examiner

*Primary Examiner* — Anthony Salata
(74) *Attorney, Agent, or Firm* — Foley & Lardner LLP

(57) ABSTRACT

A signal correction arithmetic unit is provided in a control apparatus to control a magnetic force of a magnetic guide unit. The signal correction arithmetic unit differentiates detection signals of two gap sensors, and integrates and outputs a differential signal with a smallest absolute value. The output signal is used for magnetic control.

10 Claims, 17 Drawing Sheets

MAGNETIC GUIDE APPARATUS

CROSS-REFERENCE TO RELATED APPLICATIONS

This application is based upon and claims the benefit of priority from prior Japanese Patent Application No. 2008-000144, filed Jan. 4, 2008, the entire contents of which are incorporated herein by reference.

BACKGROUND OF THE INVENTION

1. Field of the Invention

The present invention relates to a magnetic guide apparatus for guiding and running a car of an elevator along guide rails in a noncontact manner.

2. Description of the Related Art

In general, a car of an elevator is supported on a pair of guide rails which are vertically disposed in an elevation path, and the car is elevated by ropes which are wounded around a hoister. At this time, shaking of the car caused by imbalance of the load weight or movement of passengers is suppressed by the guide rails.

A contact-type guide apparatus is usually used as a guide apparatus for guiding the car in the direction of elevation. Specifically, roller guides comprising suspensions and wheels made to contact the guide rails, or guide shoes which slide over the guide rails and guide the car, are used.

In the contact-type guide apparatus, however, vibration or noise is caused by deformation of the guide rails or at joints of the guide rails. In addition, noise is generated when the roller guides are rotated. This arises a problem that the comfortability of an elevator is decreased.

In order to solve this problem, a method of guiding a car in the direction of elevation in a noncontact manner has been proposed, as disclosed in Jpn. Pat. Appln. KOKAI Publication No. H5-178563 or Jpn. Pat. Appln. KOKAI Publication No. 2001-19286.

In the method of KOKAI H5-178563, a guide apparatus comprising electromagnets is used. The guide apparatus is mounted on the car, and magnetic force is caused to act on iron-made guide rails, thereby guiding the car in a noncontact manner. Specifically, electromagnets, which are disposed at four corners of the car, surround the guide rails from three directions, and the magnetization of each electromagnet is controlled in accordance with the size of the gap between the guide rail and the guide apparatus, thereby guiding the car along the guide rails in a noncontact manner.

The above-described KOKAI 2001-19286 discloses the use of permanent magnets in order to solve problems, such as a decrease in controllability and an increase in power consumption, which occur in the guide apparatus using the electromagnets. By using permanent magnets and electromagnets in combination, the car can be supported with a low rigidity/long stroke, with power consumption being suppressed.

In usual cases, the noncontact-type guide apparatus using magnetic force is provided with gap sensors for detecting the gap between the electromagnet and the guide rail. The magnetic force is controlled in accordance with the gap that is detected by the gap sensors, and the car is supported without contacting the guide rail.

However, in general, the guide rail is disposed in such a manner that a plurality of rails each having a predetermined length are vertically connected. Accordingly, joints are present along the whole guide rail at intervals. At the parts of the joints, there are stepped portions due to the non-uniformity of the shapes of rails and the non-uniformity of the precision in disposition of rails, and the detection signal of the gap sensor is greatly disturbed instantaneously.

In addition, in the case of using a gap sensor utilizing physical properties of an object of detection, such as an eddy-current-type sensor, the detection signal at the part of the joint of the rails is disturbed more than a degree of actual variation.

As described above, if the detection signal of the gap sensor is disturbed, the control of magnetic force is also disturbed. As a result, the car is shaken, and such a problem arises that the comfortability in riding is affected.

Jpn. Pat. Appln. KOKAI Publication No. H11-71067, for instance, discloses an invention for solving the above-described problem. In KOKAI H11-71067, there is proposed a method in which a plurality of gap sensors are provided, and sensor signals which are used are properly switched on the basis of the variation of signals of the sensors.

However, in the method of switching a plurality of sensor signals, as in KOKAI H11-71067, an input sensor signal for control becomes discontinuous, and as a result, the control of magnetic force becomes unstable. In addition, in the case where there is discontinuity between the plural sensor signals, the discontinuity is detected as a signal vibration at the time of switching, and as a result, the control becomes unstable.

There are also known a method in which an upper limit is set to the variation ratio of the sensor signal, and a method in which the variation of each sensor signal is suppressed by a low-pass filter. However, when the car is actually greatly shaken by external disturbance, this movement cannot exactly be detected and the noncontact state cannot be maintained. Besides, if the phase of the sensor signal is displaced, the stability of the control system deteriorates and thus a filter with a large-delay element cannot be used.

BRIEF SUMMARY OF THE INVENTION

According to an aspect of the present invention, there is provided a magnetic guide apparatus comprising: a guide rail formed of a ferromagnetic body; a moving body which moves along the guide rail; a magnet unit which is disposed on a part of the moving body, which is opposed to the guide rail, and supports the moving body by a magnetic force in a state not in contact with the guide rail; at least two gap sensors which are disposed with a predetermined interval in a direction of movement of the moving body, and detect a gap between the magnet unit and the guide rail; a signal correction arithmetic unit which differentiates detection signals which are output from the gap sensors, integrates a differential signal with a smallest absolute value, and outputs the signal for magnetic control; and a control device which controls the magnetic force of the magnet unit based on the signal for magnetic control, which is output from the signal correction arithmetic unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

First Embodiment

Figure 1:
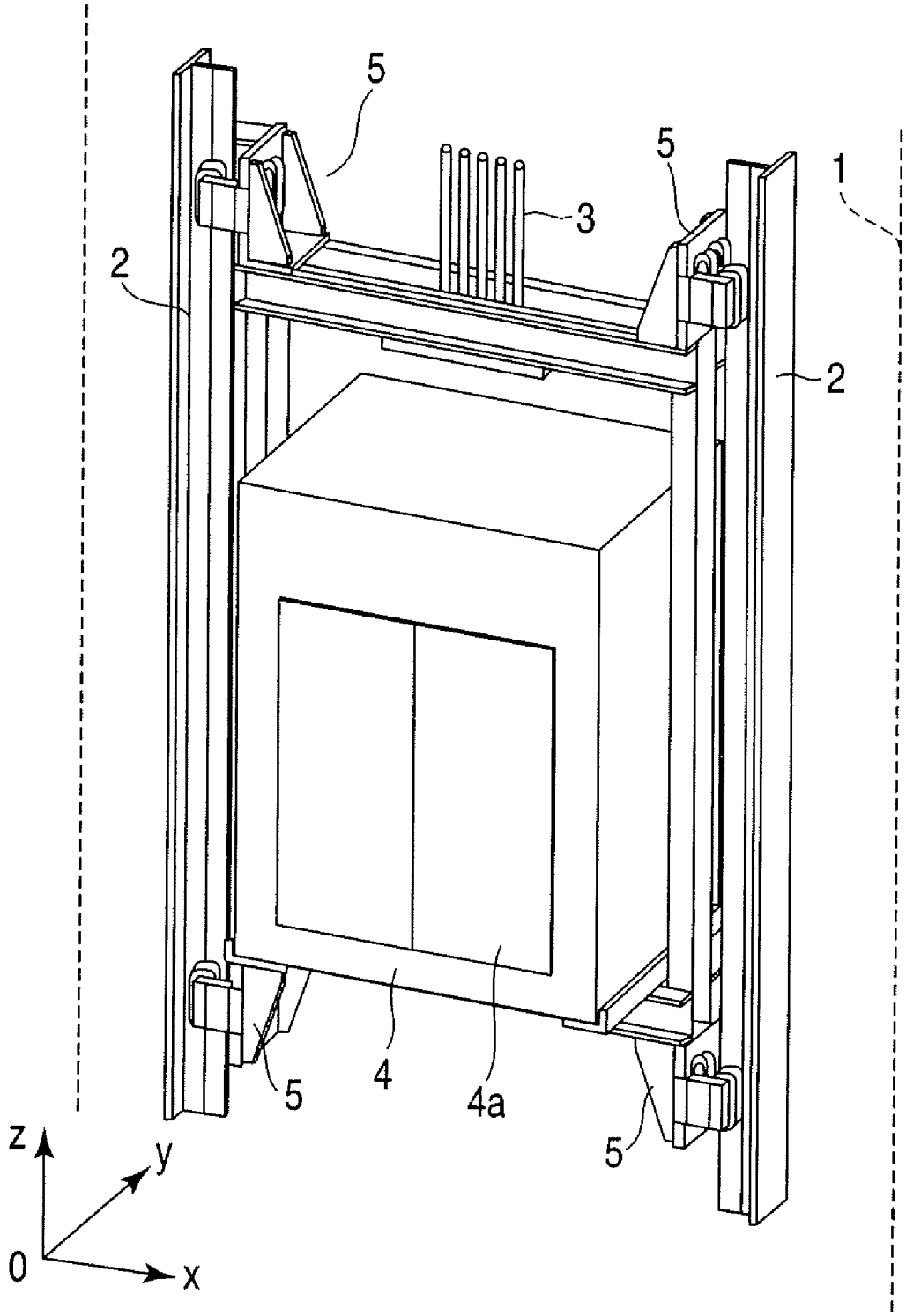
FIG. 1 is a perspective view of a magnetic guide apparatus according to a first embodiment of the present invention, applied to a car of an elevator.

FIG. 1 is a perspective view of a magnetic guide apparatus according to a first embodiment of the present invention, applied to a car of an elevator.

As is shown in FIG. 1, a pair of guide rails 2, which are formed of iron-made ferromagnetic bodies, is provided upright in an elevation path 1 of the elevator. A car 4 is suspended by ropes 3 which are wound around a hoister (not shown). With the rotation of the hoister, the car 4 is elevated along the guide rails 2. Reference numeral 4*a* denotes a car door. The car door 4*a* is opened/closed when the car 4 arrives at each floor.

It is assumed that when the car door 4*a* of the car 4 is viewed in the frontal direction, the right-and-left direction of the car door 4*a* is an x axis, the back-and-forth direction is a y axis, and the up-and-down direction is a z axis.

Magnetic guide apparatuses 5 are attached to coupling parts at four corners of the car 4, namely, upward, downward, leftward and rightward corners of the car 4, in a manner to face the guide rails 2. As will be described later, by controlling the magnetic force of the magnetic guide apparatuses 5, the car 4 levitates from the guide rails 2 and runs in a noncontact manner.

Figure 2:
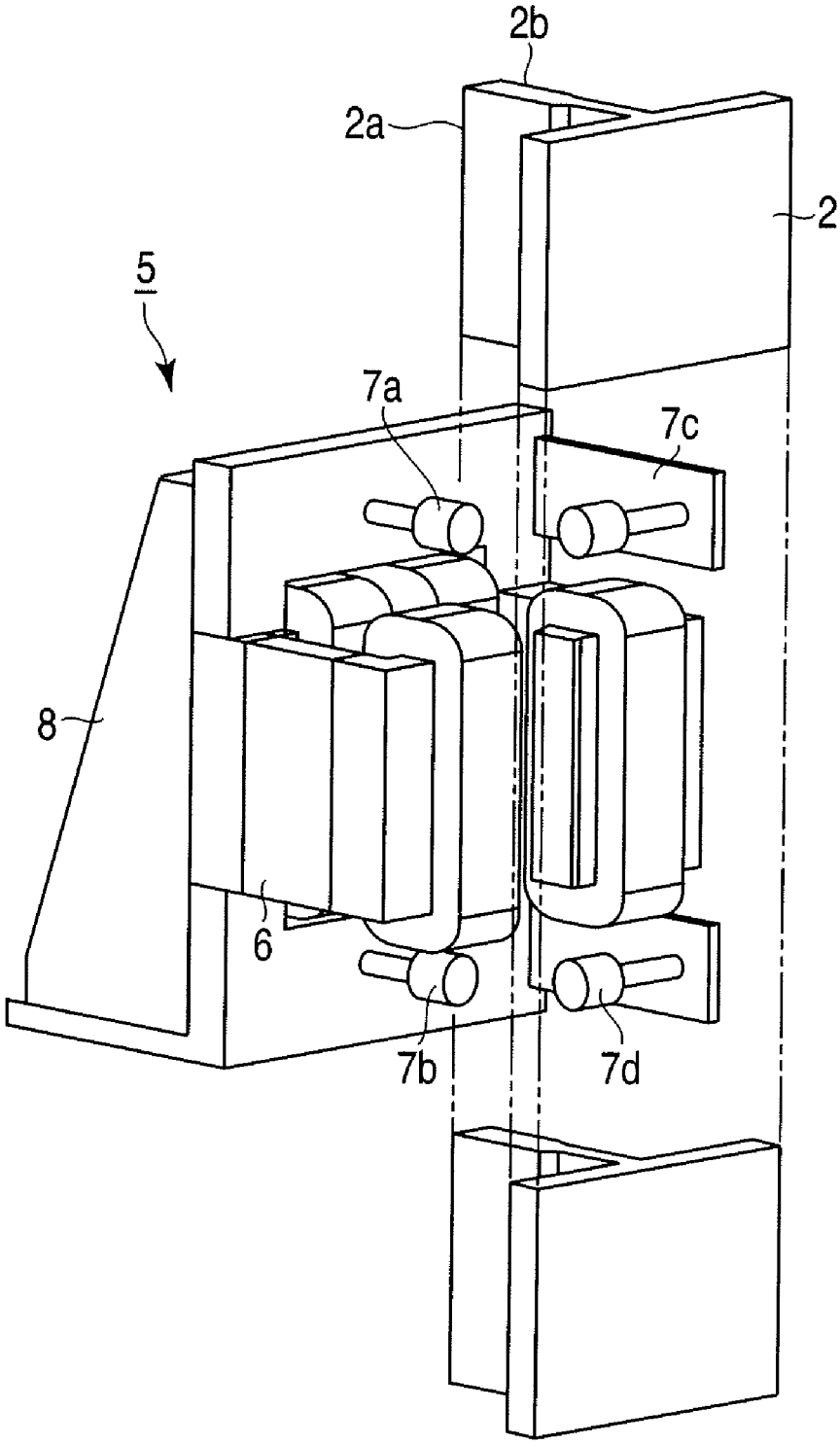
FIG. 2 is a perspective view showing a configuration of the magnetic guide apparatus according to the first embodiment.

FIG. 2 is a perspective view showing a configuration of the magnetic guide apparatus 5.

The magnetic guide apparatus 5 comprises a magnet unit 6, gap sensors 7*a* to 7*d* which detect the distance between the magnet unit 6 and the guide rail 2, and a base 8 which supports the magnet unit 6 and gap sensors 7*a* to 7*d*. As shown in FIG. 1, the magnetic guide apparatuses 5 are attached to coupling parts at four corners of the car 4, namely, upward, downward, leftward and rightward corners of the car 4, and have the same structure.

Of the gap sensors 7*a* to 7*d*, the sensors 7*a* and 7*b* are opposed to an inside surface 2*a* of the guide rail 2 having a T-shaped cross section. The sensors 7*a* and 7*b* are disposed with a predetermined distance in the longitudinal direction of the guide rail 2. The sensors 7*c* and 7*d* are opposed to a lateral side surface 2*b* of the guide rail 2 having the T-shaped cross section. The sensors 7*c* and 7*d* are disposed with a predetermined distance in the longitudinal direction of the guide rail 2.

Figure 3:
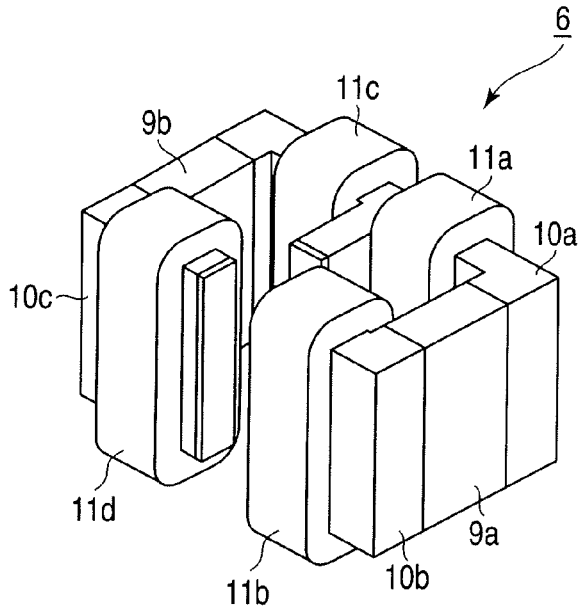
FIG. 3 is a perspective view showing a configuration of a magnet unit, which is provided in the magnetic guide apparatus according to the first embodiment.

FIG. 3 is a perspective view showing a configuration of the magnet unit 6 which is provided in the magnetic guide apparatus 5.

The magnet unit 6 comprises permanent magnets 9*a* and 9*b*, yokes 10*a*, 10*b* and 10*c*, and coils 11*a*, 11*b*, 11*c* and 11*d*. The yokes 10*a*, 10*b* and 10*c* have their magnetic poles opposed to the guide rail 2 in such a manner as to surround the guide rail 2 in three directions. The coils 11*a*, 11*b*, 11*c* and 11*d* are wound around the yokes 10*a*, 10*b* and 10*c* functioning as iron cores, thus constituting electromagnets whose magnetic fluxes at magnetic pole portions can be controlled.

With the above-described structure, the coils 11 are excited on the basis of the quantity of state in a magnetic circuit, which is detected by the gap sensors 7, etc. If the coils 11 are excited, the guide rail 2 and the magnet unit 6 are spaced apart by the magnetic force that is generated, and the car 4 is levitated.

Figure 4:
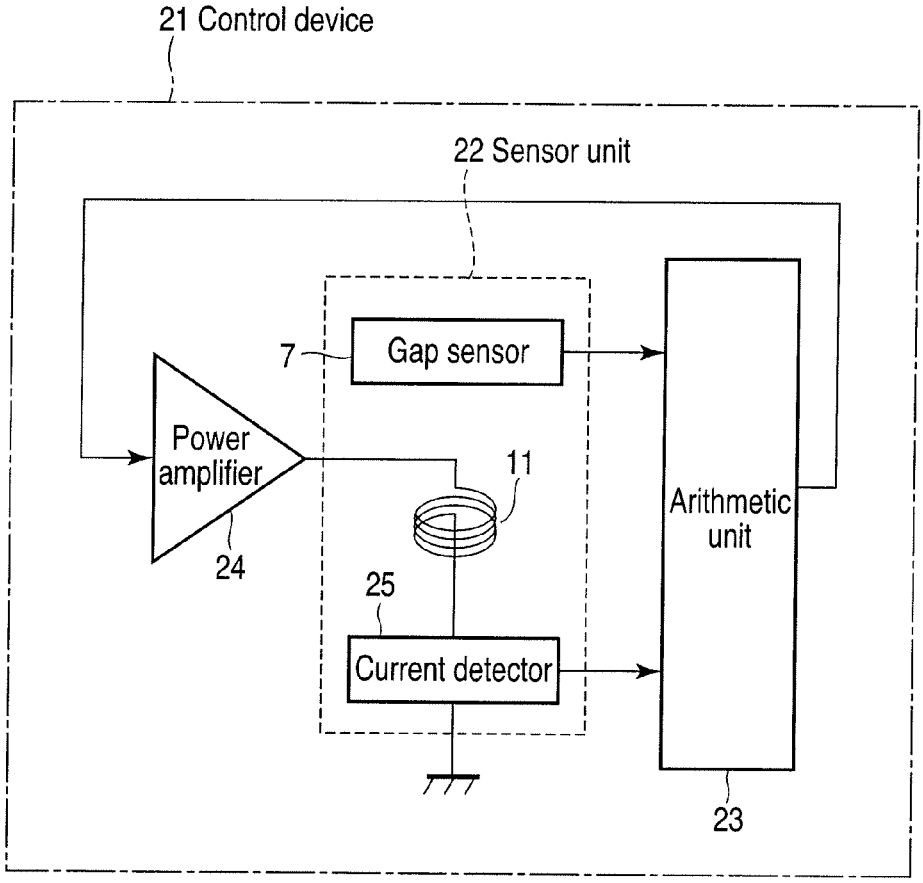
FIG. 4 is a block diagram showing a configuration of a control device for controlling the magnetic guide apparatus according to the first embodiment.

FIG. 4 is a block diagram showing a configuration of a control device 21 for controlling the magnetic guide apparatus 5.

The control device 21 includes a sensor unit 22, an arithmetic unit 23 and a power amplifier 24. The control device 21 controls the attraction force of the magnet unit 6 which is disposed at each of the four corners of the car 4. For the purpose of convenience, FIG. 4 depicts the sensor unit 22 as being included in the control device 21. Actually, the sensor unit 22 is provided on the magnet unit 6 side.

The arithmetic unit 23 calculates a voltage which is to be applied to each coil 11, on the basis of a signal which is output from the sensor unit 22. The power amplifier 24 supplies power to each coil 11 on the basis of the output from the arithmetic unit 23.

The sensor unit 22 is composed of a gap sensor 7 (7*a* to 7*d*) and a current detector 25. The gap sensor 7 is a sensor for detecting the size of the gap between the magnet unit 6 of the magnetic guide apparatus 5 and the guide rail 2. The current detector 25 detects the value of an electric current which flows in each coil 11.

With the above-described structure, the current which excites each coil 11 is controlled so as to keep a predetermined gap length between the magnet unit 6 and the guide rail 2. In the state in which the car 4 is supported in a noncontact manner, the value of the current flowing in each coil 11 at this time is fed back via an integrator. Thereby, in a steady state, the car 4 can stably be supported by the attraction force of the permanent magnets 9, regardless of the weight of the car 4 and the magnitude of unbalanced force. This control is called "zero-power control".

By this zero-power control, the car 4 can stably be supported in the state in which the car 4 is not in contact with the guide rails 2. In addition, in the steady state, the current flowing in each coil gradually decreases to zero, the force that is needed for stable support becomes only the magnetic force of the permanent magnets 9.

This also applies to the case in which the weight or balance of the car 4 varies. Specifically, in a case where some external force acts on the car 4, an electric current is caused to transitionally flow in the coils 11, thereby to adjust the gap between the magnet unit 6 and guide rail 2 at a suitable size. However, in the case where the car 4 has transitioned into the stable state once again, the current flowing in the coil 11 gradually decreases to zero by the above-described control method. It is thus possible to form a gap which has such a size that the load acting on the car 4 and the attraction force produced by the magnetic force of the permanent magnet 9 are balanced.

The structure of the magnet unit and the zero-power control are described in detail in Jpn. Pat. Appln. KOKAI Publications No. 2005-350267 and No. 2001-19286, and a detailed description thereof is omitted here.

(Gap Sensor)

A plurality of gap sensors 7 are disposed so that the distances in the respective directions of magnetic force control can be detected. The gap sensors 7 are disposed with a predetermined distance in the direction of movement of the car 4, with the magnetic unit 6 being interposed.

In the present embodiment, as shown in FIG. 2, the gap sensors 7*a* and 7*b* for detecting the distance in the right-and-left direction of the car 4 are disposed above and below the magnet unit 6, respectively. In addition, the gap sensors 7*c* and 7*d* for detecting the distance in the back-and-forth direction of the car 4 are disposed above and below the magnet unit 6, respectively. The same applies to all magnetic guide apparatuses 5 which are disposed at the four corners of the car 4.

Next, a description is given of how the gap sensors disposed on the magnetic guide apparatus 5 respond, when the magnetic guide apparatus 5 passes by the stepped portion or joint of the guide rail 2 with the movement of the car 4. In the description below, the gap sensors 7*a* and 7*b* are exemplified. However, the same applies to the other gap sensors 7*c* and 7*d*.

It is assumed that a detection signal which is output from the gap sensor 7*a* is Ga, and a detection signal which is output from the gap sensor 7*b* is Gb. These detection signals are signals to indicate the distance (gap) between the magnetic guide apparatus 5 and guide rail 2.

FIG. 5 to FIG. 8 show the states in which the car 4 runs upward along the guide rails 2. In FIG. 5 to FIG. 8, reference numeral 2*c* denotes a joint of the guide rail 2. FIG. 9 shows signal waveforms of the gap sensors 7*a* and 7*b*.

Figure 5:
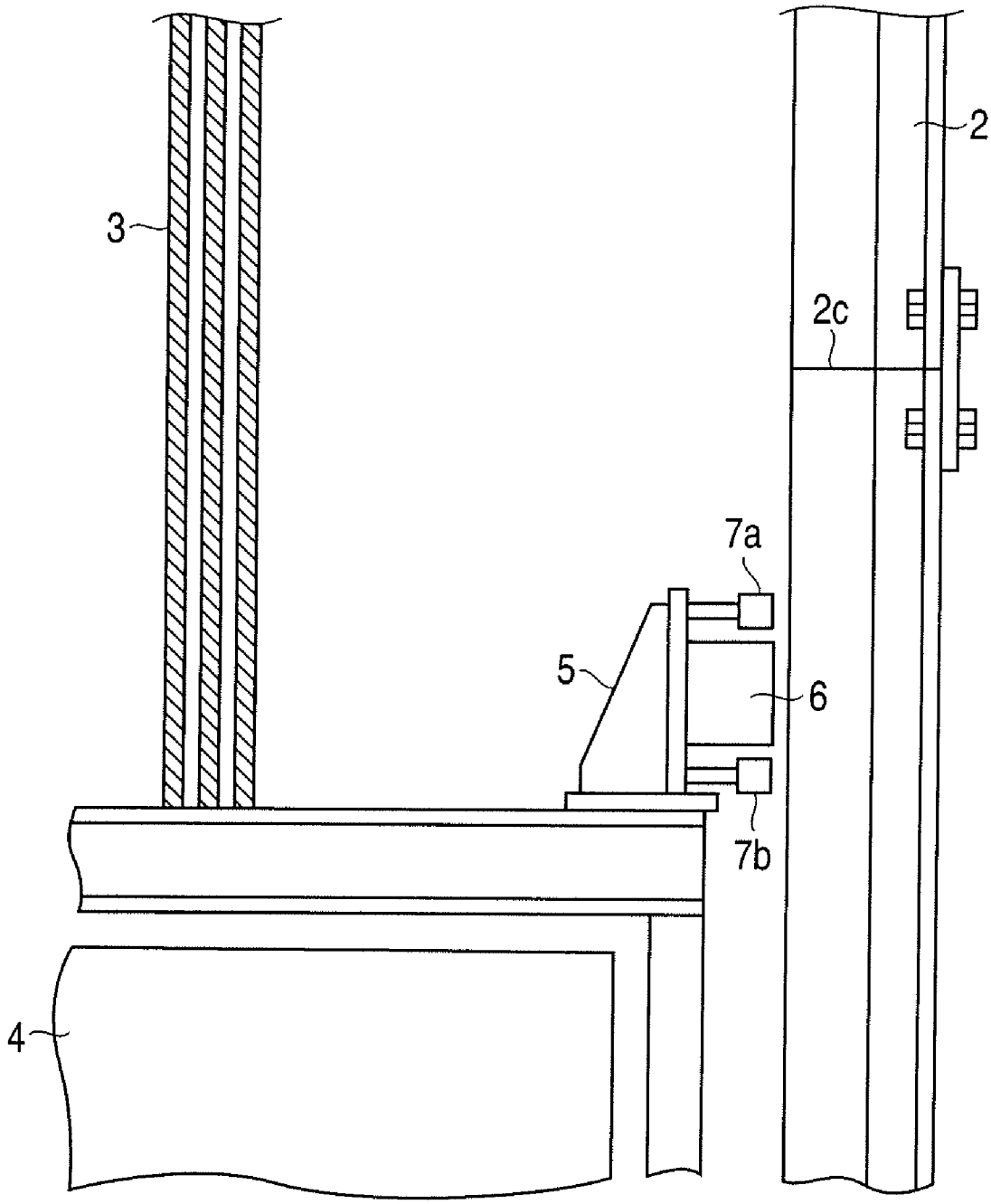
FIG. 5 shows a positional relationship between gap sensors and guide rails of the magnetic guide apparatus according to the first embodiment.

As shown in FIG. 5, in the case where the gap sensors 7*a* and 7*b* are opposed to a continuous part of the guide rail 2, the detection signals Ga and Gb, which are output from the gap sensors 7*a* and 7*b*, have smooth response characteristics. In this state, the gap between the magnet unit 6 and the guide rail 2 can exactly be detected by the gap sensors 7*a* and 7*b*.

Figure 6:
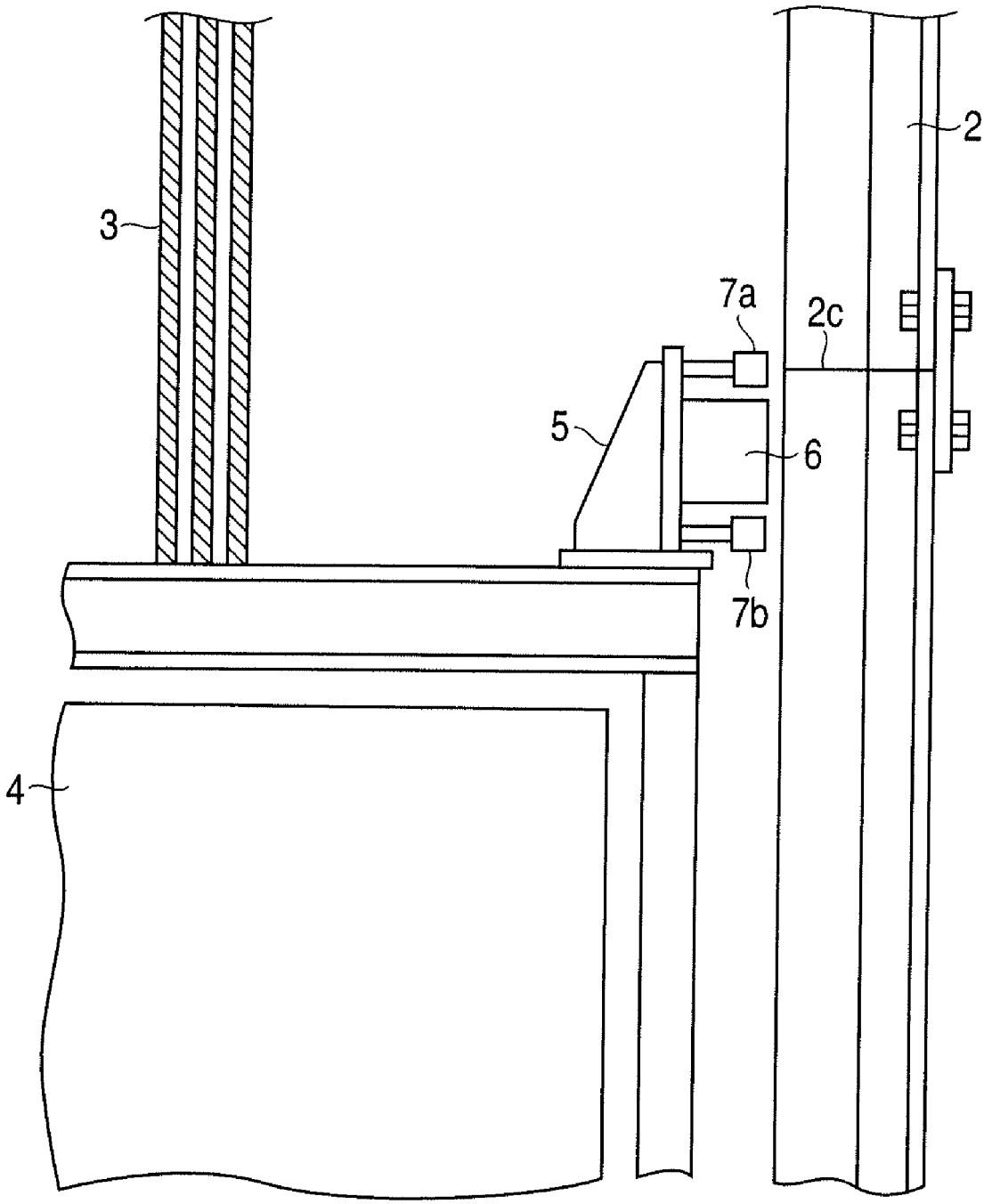
FIG. 6 shows a positional relationship between the gap sensors and guide rails of the magnetic guide apparatus according to the first embodiment.

As shown in FIG. 6, if the car 4 approaches the joint 2*c* of the guide rail 2, the gap sensor 7*a* first passes by the joint 2*c* of the guide rail 2. At this time, as shown in a part A in FIG. 9, the detection signal Ga of the gap sensor 7*a* is greatly disturbed due to, e.g. a variation in material characteristics of the part of the joint 2*c*. On the other hand, the gap sensor 7*b*, which has not yet approached the part of the joint 2*c* of the guide rail 2, responds smoothly at this time.

Figure 7:
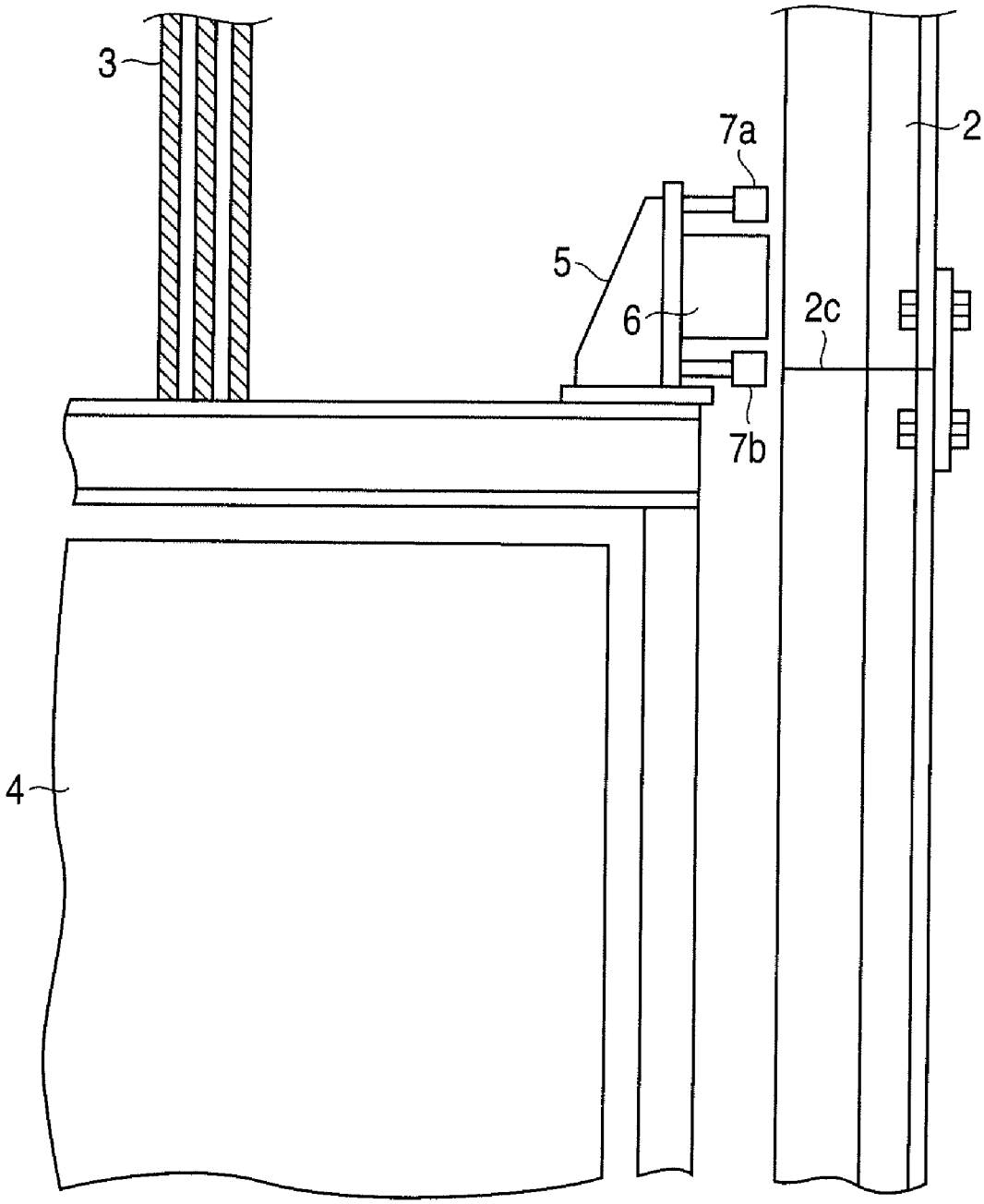
FIG. 7 shows a positional relationship between the gap sensors and guide rails of the magnetic guide apparatus according to the first embodiment.

As shown in FIG. 7, if the gap sensor 7*b* passes by the vicinity of the joint 2*c*, the detection signal Gb of the gap sensor 7*b* is greatly disturbed instantaneously, as shown in a part B in FIG. 9. On the other hand, the detection signal Ga of the gap sensor 7*a* restores to the smooth state.

Figure 8:
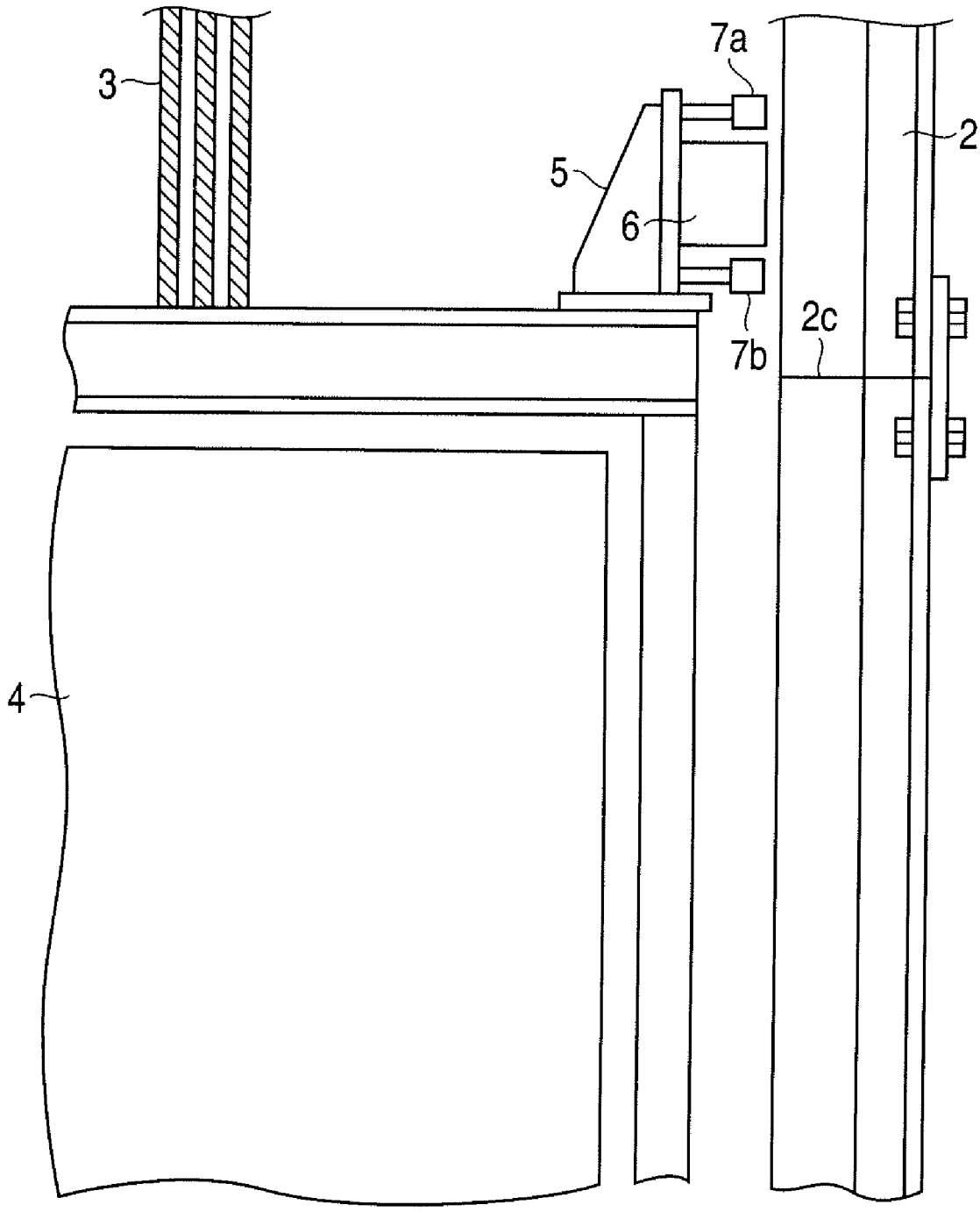
FIG. 8 shows a positional relationship between the gap sensors and guide rails of the magnetic guide apparatus according to the first embodiment.
Figure 9:
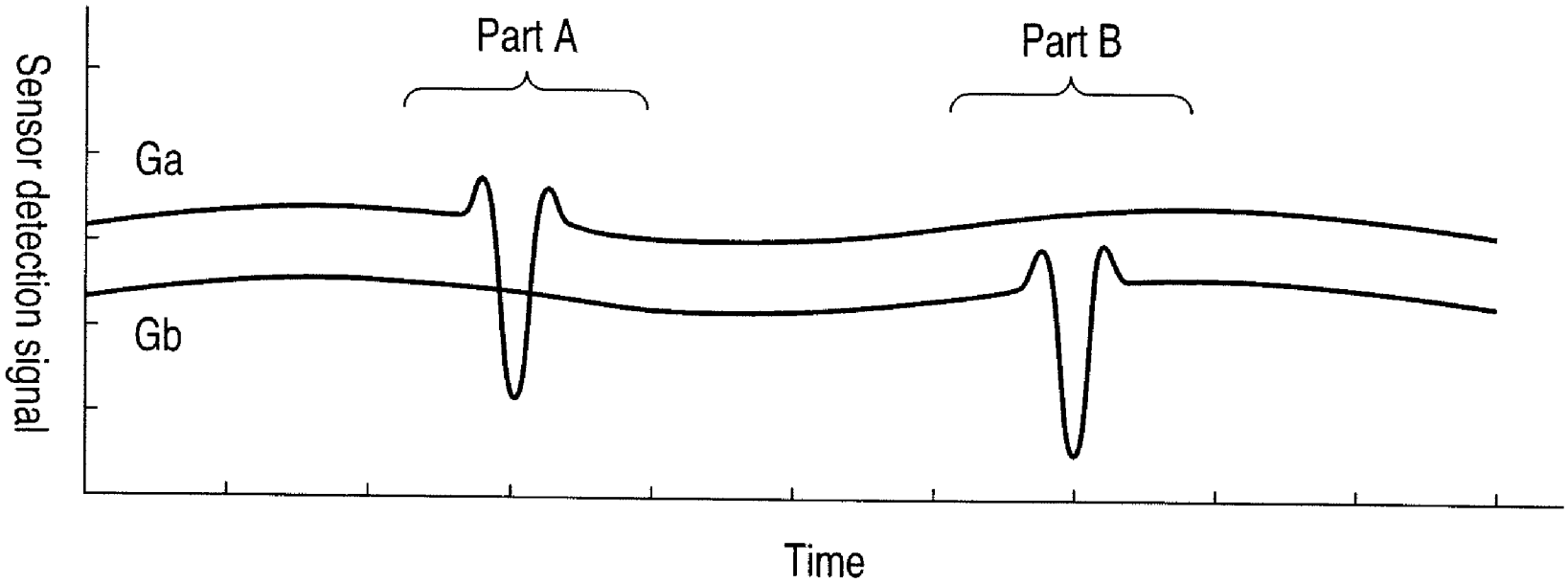
FIG. 9 is a graph showing signal waveforms of the gap sensors of the magnetic guide apparatus according to the first embodiment.

As shown in FIG. 8, after the gap sensors 7*a* and 7*b* have passed by the joint 2*c* of the guide rail 2, the continuous part of the guide rail 2 becomes an object of detection. In this state, both the gap sensors 7*a* and 7*b* respond smoothly, and the gap between the magnet unit 6 and the guide rail 2 can exactly be detected.

As has been described above, if the detection signal Ga, Gb is greatly disturbed at the joint 2*c* of the guide rail 2, a displacement signal, which is not related to the actual movement of the car 4, is delivered to the control device 21. Consequently, the magnetic control becomes unstable, and the car 4 is unnecessarily shaken.

In other words, if the detection signals Ga and Gb are disturbed, as shown in the parts A and B in FIG. 9, the control device 21 erroneously recognizes shaking of the car 4. As a result, the control device 21 controls the magnetic guide apparatus 5 in such a direction as to suppress the shaking, and thus shakes the car 4.

(Signal Correction Process)

In order to solve the above-described problem, it can be thought to control the magnetic force, for example, by using an average value of the two detection signals Ga and Gb. However, in this method, although the disturbance of the detection signal can be reduced, the disturbance itself remains, and smooth control cannot be executed.

Figure 10:
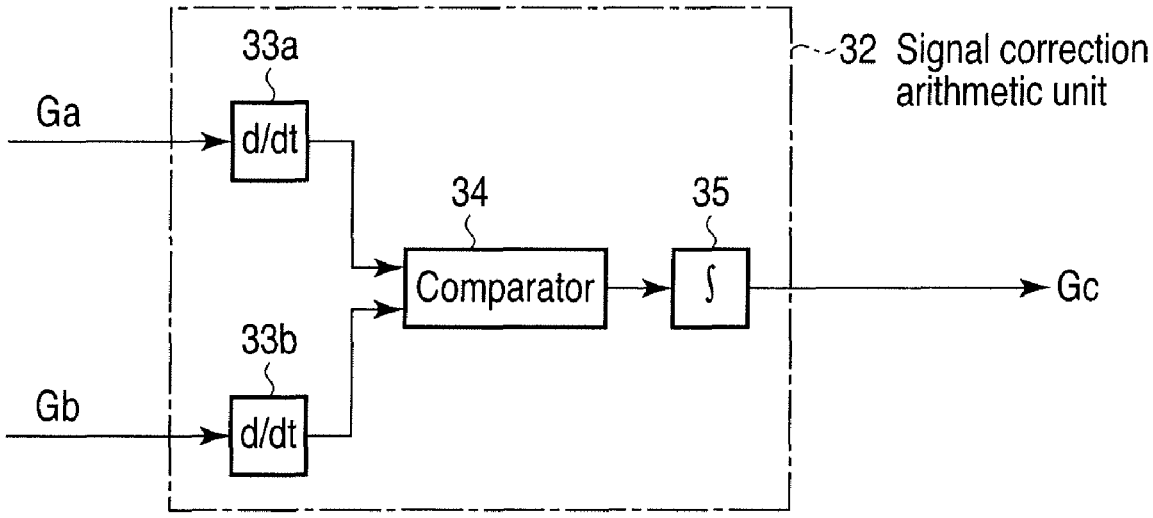
FIG. 10 is a block diagram showing a configuration of a signal correction arithmetic unit in the first embodiment.

To cope with this, in the present embodiment, a signal correction arithmetic unit 32, as shown in FIG. 10, is used. The signal correction arithmetic unit 32 is included in the arithmetic unit 23 shown in FIG. 4. The signal correction arithmetic unit 32 receives the detection signal Ga that is output from the gap sensor 7*a*, and the detection signal Gb that is output from the gap sensor 7*b*, and generates and outputs a signal Gc in which the disturbances of the detection signals Ga and Gb are corrected.

As shown in FIG. 10, the signal correction arithmetic unit 32 comprises differentiators 33*a* and 33*b*, a comparator 34, and an integrator 35.

The differentiator 33*a* differentiates the detection signal Ga of the gap sensor 7*a*. The differentiator 33*b* differentiates the detection signal Gb of the gap sensor 7*b*. If the detection signals Ga and Gb are differentiated, their variation amounts can be found.

Actually, it is not possible to fabricate a "differentiator" which can perform an exact differential arithmetic operation.

Thus, in usual cases, a "quasi-differentiator" is used. The term "differentiator", in this description, includes the "quasi-differentiator".

The comparator 34 compares the output signals of the differentiators 32*a* and 32*b*, and selects a smaller signal (a signal with a smallest absolute value of differentiation). The integrator 35 integrates the signal selected by the comparator 34. The signal Gc output from the integrator 35 is used as a signal for magnetic control.

In the above configuration, the detection signals Ga and Gb output from the cap sensors 7*a* and 7*b* are differentiated by the differentiators 32*a* and 32*b*, respectively, and applied to the comparator 34. The comparator 34 compares the differential values of both inputs signals, and outputs one of the signals with a smaller absolute value. The signal output from the comparator 34 is integrated by the integrator 35, and output as a signal Gc for magnetic control.

By once differentiating the detection signals Ga and Gb, it is possible to cancel the offset amount that is slightly different by the yield and the mounting positions of the sensors 7*a*, 7*b*, 7*c* and 7*d*. Further, when using one of the detection signals Ga and Gb by integrating it, a sudden change caused by switching the signals can be prevented.

As described above, by differentiating the detection signals Ga and Gb, and outputting one of them with less fluctuation as a signal for magnetic control, stable control is possible by using a smooth signal not affected by a noise of the other signal, even if a noise is mixed into the detection signals Ga and Gb as shown in FIG. 9.

Figure 11:
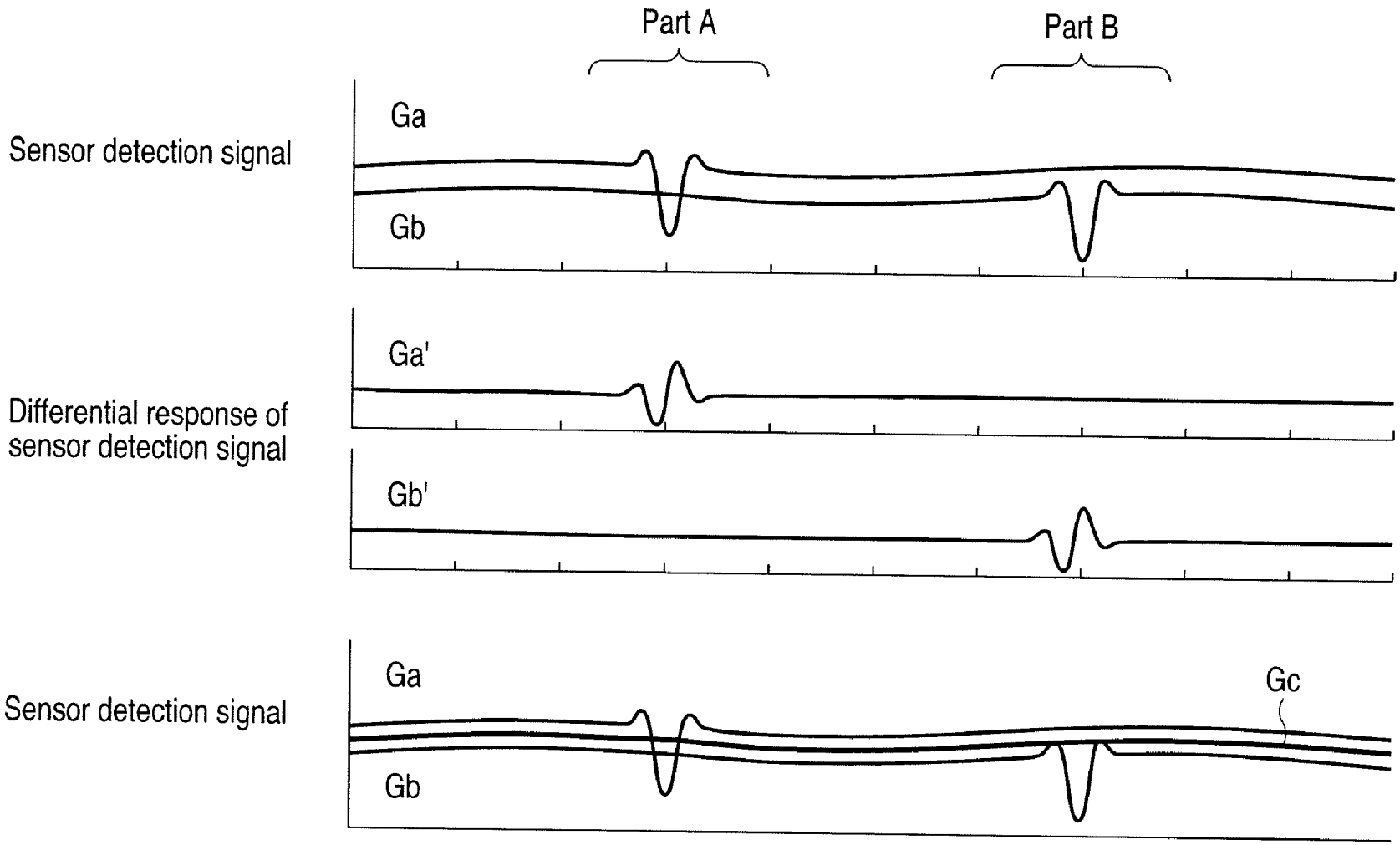
FIG. 11 is a graph showing response characteristics of signals of the signal correction arithmetic unit in the first embodiment.

FIG. 11 is a graph showing response characteristics of signals of the signal correction arithmetic unit 32. It is now assumed that a detection signal output from the gap sensor 7*a* is Ga, a detection signal output from the gap sensor 7*b* is Gb, and differential signals thereof are Ga' and Gb'.

The differential signal Ga' and Gb' sharply vary when the detection signal Ga and Gb are disturbed at the joint 2*c* of the guide rail 2. On the other hand, the differential signal Ga' are Gb' don't sharply vary at a continued part of the guide rail 2. Accordingly, at a part A in FIG. 11, the absolute value of the differential signal Ga' is greater than that of the differential signal Gb'.

Therefore, if the comparator 34 selects a differential signal with a smaller absolute value, and the integrator 35 integrates the selected differential signal, it is possible to obtain a detection signal Gc that continues to the detection signal Ga or Gb with a smaller variation amount.

In this manner, the output signal Gc with little disturbance is finally generated, and is delivered to the control device 21 as a signal for magnetic control. Therefore, even if the detection signal Ga or Gb is disturbed at the joint 2*c* of the guide rail 2, the car 4 is not unnecessarily shaken, stable magnetic control is always executed, and the car 4 can be run and guided in a noncontact manner.

Further, as the detection signals Ga and Gb are not directly used, and the differential signals of them are used after being integrated, smooth control is possible by suppressing a sudden signal change, compared with the method of simply comparing and switching the detection signals Ga and Gb.

Second Embodiment

Next, a second embodiment of the present invention is described.

The second embodiment relates to pre-processing of a sensor signal. In the first embodiment, the detection signals Ga and Gb of gap sensors 7*a* and 7*b* are directly input to the signal correction arithmetic unit 32. In the second embodiment, the detection signals Ga and Gb are input to the signal correction arithmetic unit 32, after a relative difference between the detection signals is corrected.

A specific configuration of the second embodiment is explained hereinafter.

Figure 12:
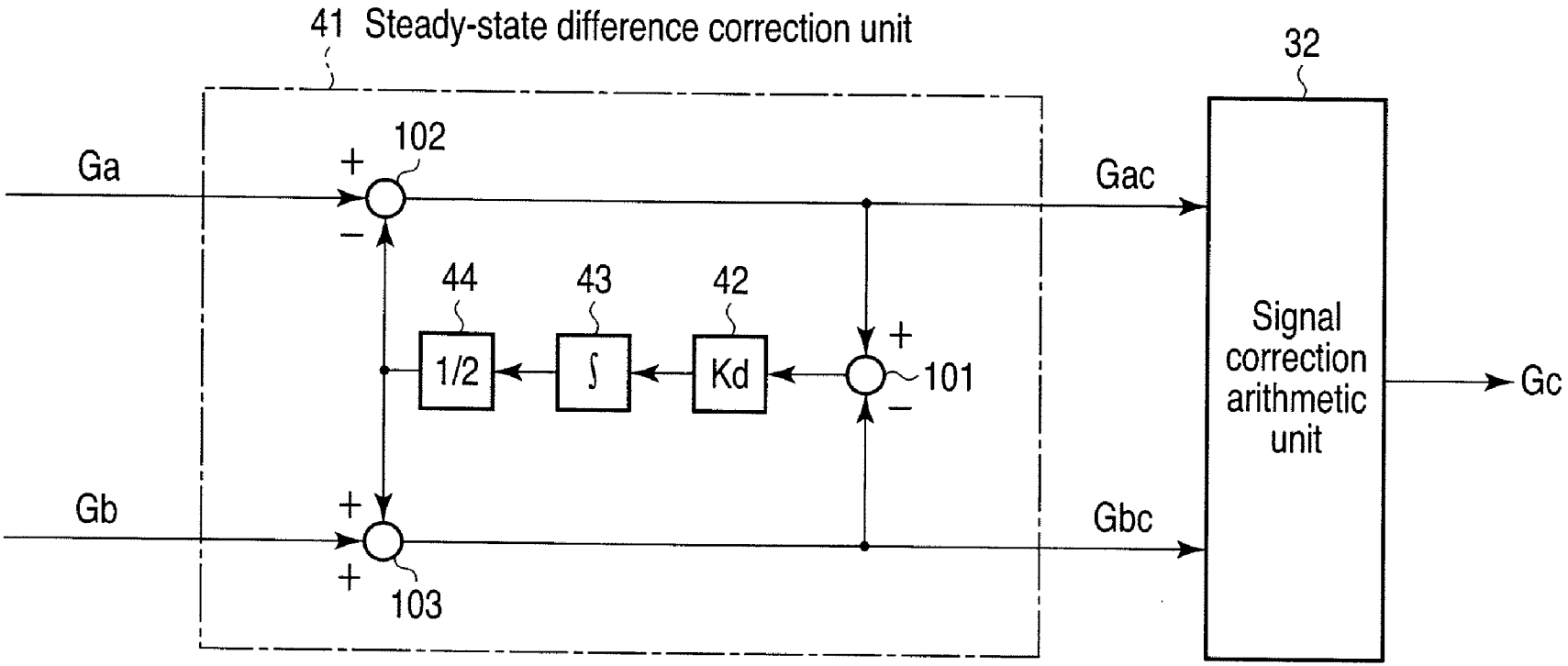
FIG. 12 is a block diagram showing a configuration of a steady-state difference correction unit according to a second embodiment of the present invention.
Figure 13:
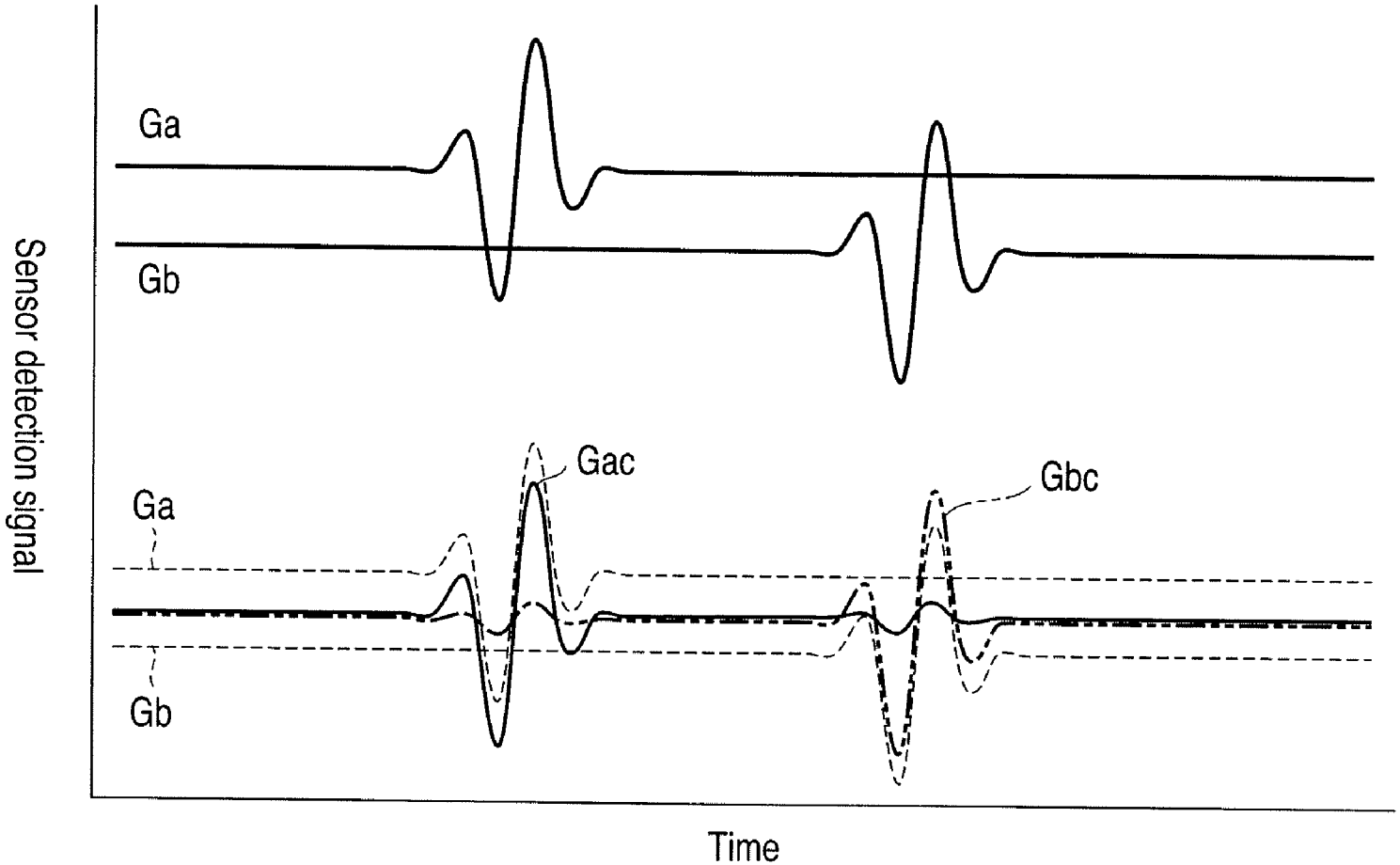
FIG. 13 is a graph showing response characteristics of signals of the steady-state difference correction unit in the second embodiment.

FIG. 12 is a block diagram showing a configuration of the second embodiment of the present invention. A steady-state difference correction unit 41 is provided in a stage preceding to the signal correction arithmetic unit 32. The steady-state difference correction unit 41 is provided in the arithmetic unit 23 shown in FIG. 4, together with the signal correction arithmetic unit 32. The configuration of the magnetic guide unit 5 is similar to the first embodiment.

As shown in FIG. 12, the steady-state difference correction unit 41 comprises a subtracter 101, a gain multiplier 42, an integrator 43, a distribution coefficient multiplier 44, a subtracter 102, and an adder 103.

The subtracter 101 calculates the difference between the detection signals Ga and Gb of the gap sensor 7*a* and 7*b*. The gain multiplier 42 multiplies the difference signal between the detection signals Ga and Gb that is output from the subtracter 101 by a predetermined feedback gain Kd, and outputs the product to the integrator 43. The integrator 43 integrates the output signal of the gain multiplier 42, and outputs the integrated signal to the distribution coefficient multiplier 44.

The distribution coefficient multiplier 44 multiplies the output signal of the integrator 43 by ½ as a distribution coefficient, and outputs the multiplied signal to the subtracter 102 and adder 103. The subtracter 101 calculates a difference between the detection signal Ga, which has been input to the steady-state difference corrector 41, and a feedback signal, and outputs the difference to the signal correction arithmetic unit 32 as a correction detection signal Gac. The adder 103 adds a feedback signal to the detection signal Gb which has been input to the steady-state difference correction unit 41, and outputs the added signal to the signal correction arithmetic unit 32 as a correction detection signal Gbc.

In the above configuration, the steady-state difference correction unit 41 feeds back the difference signal between the detection signals Ga and Gb of the gap sensors 7*a* and 7*b*, to the detection signals Ga and Gb through the gain multiplier 42 and integrator 43.

By setting a feedback gain Kd to an appropriate value, the relative difference between the detection signals Ga and Gb can be reduced to zero with little influence of a sudden change in the detection signals Ga and Gb.

At this time, if the distribution coefficient of the distribution coefficient multiplier 44 is set to "½", and the difference signal is fed back to the detection signals Ga and Gb at the equivalent distribution, the correction detection signals Gac and Gbc can be brought to values close to a mid value between the detection signals Ga and Gb. Namely, if the value of the detection signal Ga is "7", and the value of the detection signal Gb is "8", for example, the values of the correction detection signals Gac and Gbc can be set to "7.5".

As described above, if the relative difference between two detection signals Ga and Gb is previously corrected, and applied to the signal correction arithmetic unit 32, a smoother output signal Gc can be generated. High-precision control is possible by using the output signal Gc.

Third Embodiment

Next, a third embodiment of the present invention is described.

In the first embodiment, the detection signals are differentiated, one of the signals with a smaller absolute value is integrated, and the output signal Gc is generated. However, if the detection signals Ga and Gb are differentiated and integrated, the resultant signals may be different from actual gap values even the error is a very small. In the third embodiment, to correct the error caused by the differentiation and integration, the output signal Gc is corrected by using a mean value between the detection signals Ga and Gc as a representative value.

A specific configuration of the third embodiment is explained hereinafter.

Figure 14:
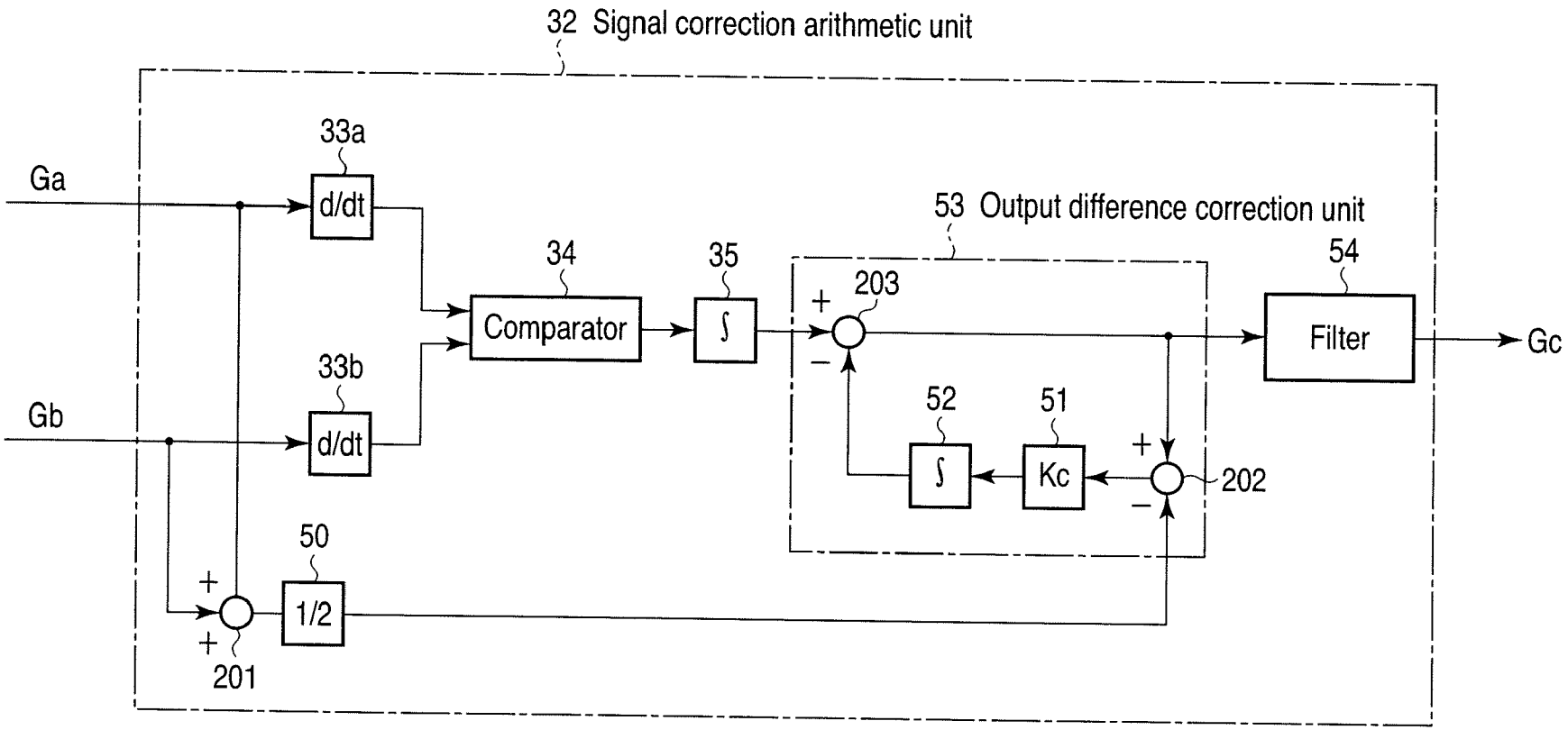
FIG. 14 is a block diagram showing a configuration of a signal correction arithmetic unit according to a third embodiment of the present invention.

FIG. 14 is a block diagram showing a configuration of a signal correction arithmetic unit 32 according to the third embodiment of the invention. The same reference numbers are given to the same parts of the first embodiment shown in FIG. 10, and a description thereof is omitted here. The structure of the magnetic guide unit 5 is the same as in the first embodiment.

The third embodiment is different from the first embodiment (FIG. 10) in that an adder 201, a ½ arithmetic unit 50, an output difference correction unit 53 and a filter 54 are added to the signal correction arithmetic unit 32.

The adder 201 adds the detection signals Ga and Gb of the gap sensors 7*a* and 7*b*. The ½ arithmetic unit 50 calculates the added value obtained from the adder 201 to ½, and generates a representative signal for signal correction by averaging the detection signals Ga and Gb.

The output difference correction unit 53 is provided in a stage subsequent to the integrator 35. The output difference correction unit 53 corrects the output signal (the signal obtained by integrating the differential signal Ga' or Gb') of the integrator 35 by the output signal (the representative signal obtained by averaging the detection signals Ga and Gb) of the ½ arithmetic unit 50.

The output difference correction unit 53 comprises a subtracter 202, a gain multiplier 51, an integrator 52, and a subtracter 203. The subtracter 202 calculates a difference between the output signals of the integrator 35 and ½ arithmetic unit 50. The gain multiplier 51 multiplies the difference signal output from the subtracter 202 by a predetermined feedback gain Kc, and outputs the resultant signal to the integrator 52. The integrator 52 integrates the output signal of the gain multiplier 51, and outputs the resultant signal to the subtracter 203. The subtracter 203 calculates the difference between the output signals of the integrator 35 and integrator 52, and outputs the resultant signal as a signal Gc for magnetic control. The signal Gc is output to the control system through the filter 54.

In the configuration described above, as in the first embodiment, the detection signals Ga and Gb output from the gap sensors 7*a* and 7*b* are differentiated by the differentiators 32*a* and 32*b*, and applied to the comparator 34. The comparator 34 compares the differential values of the input signals, and outputs one of the signals with a smaller absolute value. The signal output from the comparator 34 is applied to the integrator 35, and output as a signal Gc for magnetic control.

In the third embodiment, the averaged signal of the detection signals Ga and Gb from the ½ arithmetic unit 50 is generated as a representative signal for signal correction, and the representative signal is applied to the output difference correction unit 53. The output difference correction unit 53 calculates a difference between the representative signal and the signal output from the integrator 35, and fees back the difference signal to the output signal of the integrator 35 through the gain multiplier 51 and integrator 52. Thereby, the output signal of the integrator 35 is corrected by the representative signal obtained by averaging the detection signals Ga and Gb. And, the corrected signal is output as a signal Gc for magnetic control through the filter 54.

As described above, by correcting the output signal by feeding back the average value of the detection signals Ga and Gb, an error caused by differentiation/integration of the detection signals Ga and Gb can be suppressed, and a favorable output signal Gc can be generated.

Further, the influence of noise can be minimized by setting the gain Kc of the gain multiplier 51 to an appropriate value, and delaying the response frequency necessary for converging the signal Gc to be lower than the noise frequency detected from the detection signals Ga and Gb.

Further, in the third embodiment, the signal obtained by averaging the detection signals Ga and Gb is used for correcting an error in the signal Gc. However, it is also permitted to use one of the detection signals Ga and Gb, or to use a signal that is calculated by a method other than the averaging for the correction.

As differentiation and integration are performed in the signal correction arithmetic unit 32, the output signal Gc is delayed, and the control system may be influenced. In this case, the influence can be decreased by outputting the signal Gc through the filter 54 for correction. As a kind of the filter 54, a phase lead filter for advancing the phase of the signal Gc is used in most cases. It is permitted to combine a phase delay filter, a low-pass filter and a high-pass filter for decreasing a noise. The filter 54 is also applicable to the configuration of the first embodiment.

The configuration of the third embodiment may be combined with the steady-state difference correction unit 41 for pre-processing explained in the second embodiment.

Fourth Embodiment

Next, a fourth embodiment of the present invention is described.

In the above-described first to third embodiments, the differentiator for generating a differential signal for comparison is the same as the differentiator for generating a final output signal. However, in the fourth embodiment, a differentiator for generating a differential signal for comparison is different from a differentiator for generating a final output signal.

A specific configuration is explained hereinafter.

Figure 15:
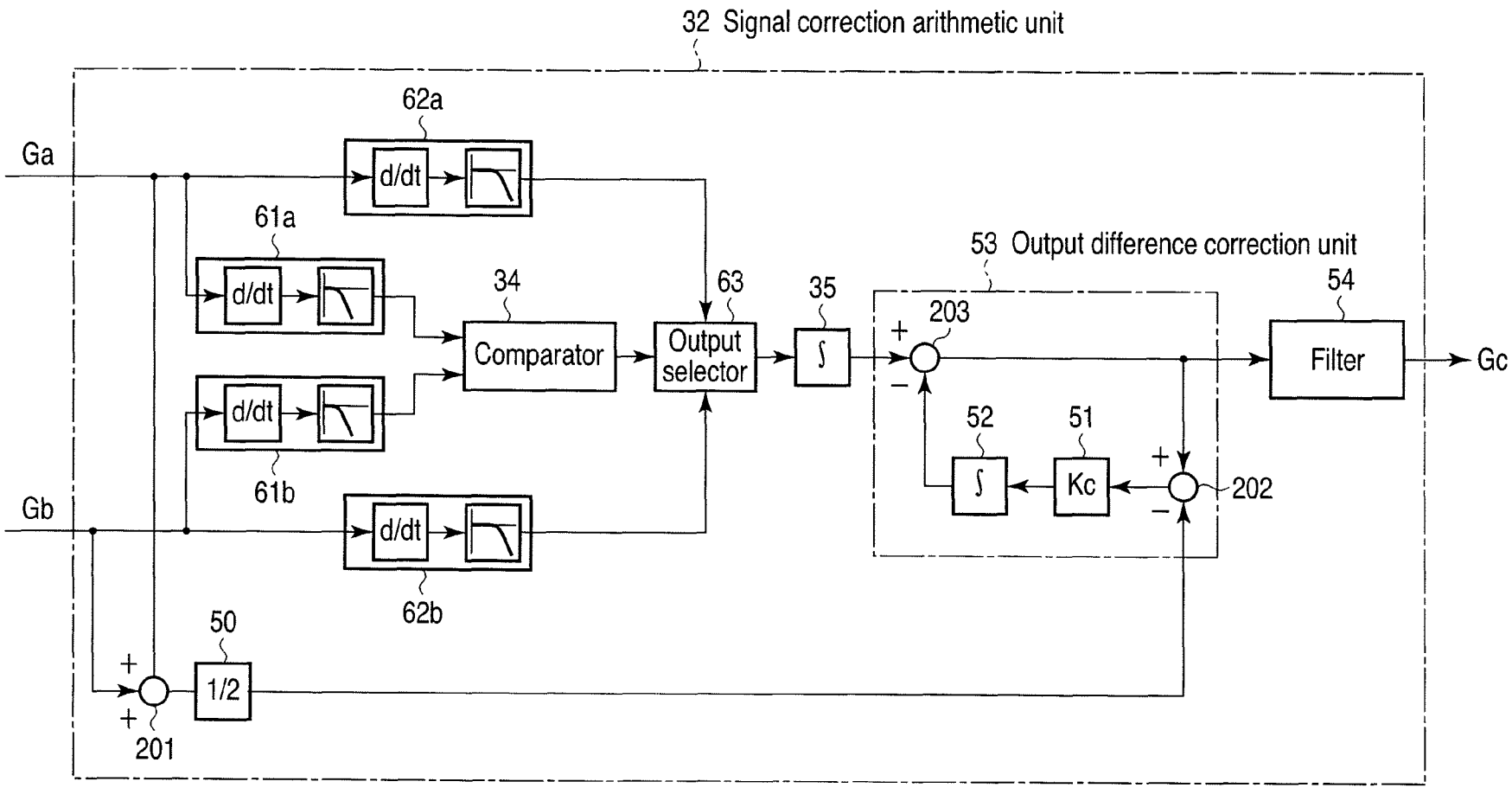
FIG. 15 is a block diagram showing a configuration of a signal correction arithmetic unit according to a fourth embodiment of the present invention.

FIG. 15 is a block diagram showing a configuration of a signal correction arithmetic unit 32 according to a fourth embodiment of the present invention. The same reference numbers are given to the same parts in the third embodiment shown in FIG. 14, and a description thereof is omitted here. The structure of the magnetic guide unit 5 is the same as in the first embodiment.

The fourth embodiment is different from the third embodiment (FIG. 14) in the point that differentiators 61*a* and 61*b* for comparison, differentiators 62*a* and 62*b* for output, and an output selector 63 are provided instead of the differentiators 33*a* and 33*b*.

The differentiators 61*a* and 61 for comparison differentiate the detection signals Ga and Gb input to the signal correction arithmetic unit 32, and output the resultant signals to the comparator 34. The response frequency bands of the differentiators 61*a* and 61*b* for comparison are set to relatively low, and are given characteristics capable of differentiating a low-frequency-band signal.

On the other hand, the differentiators 62*a* and 62*b* for output differentiate the detection signals Ga and Gb that are input to the signal correction arithmetic unit 32, and output the resultant signals to the output selector 63. The response frequency bands of the differentiators 62*a* and 62*b* for output are set to relatively high, and are given characteristics capable of differentiating a high-frequency-band signal.

The output selector 63 selects the signal differentiated by the differentiator 62*a* for output or the differentiator 62*b* for output, as an output object, based on the result of comparison in the comparator 34, and applies the selected signal to the integrator 35.

In the configuration described above, the detection signals Ga and Gb output from the gap sensors 7*a* and 7*b* are differentiated by the differentiators 61*a* and 61*b*, and the resultant differential signals are applied to the comparator 34. In this case, as the response frequency band of the differentiators 61*a* and 61 for comparison are set to relatively low, the comparator 34 is supplied with a relatively smooth differential signal with a high-frequency component (a noise component) removed. As a result, frequent switching of signals caused by a micro noise included in the detection signals Ga and Gb is prevented.

On the other hand, the detection signals Ga and Gb output from the gap sensors 7*a* and 7*b* are also applied to the differentiators 62*a* and 62*b* for output, and the differential signals of these differentiators 62*a* and 62*b* for output are applied to the output selector 63.

The output selector 63 selects one of the differential signals from the differentiators 62*a* and 62*b* for output, as an output object, based on the result of comparison in the comparator 34, and outputs the selected signal to the integrator 35. In this case, a signal for output is desirably given a response characteristic including a high-frequency area to become able to sufficiently detect the state of movement of the car 4. Therefore, a high-precision signal can be generated by using a response characteristic able to respond to a relatively high frequency, as the response frequencies of the differentiators 62*a* and 62*b*.

The subsequent operations are the same as those in the third embodiment, and an explanation thereof is omitted here.

As described above, by using the differentiators 61*a* and 61*b* for comparison which generate a differential signal for comparison, and the differentiators 62*a* and 62*b* for output which generate a final output signal, a smooth and precise signal Gc can be generated and output as a signal for magnetic control.

The configuration of the fourth embodiment may be combined with the steady-state correction unit 41 for pre-processing explained in the second embodiment.

Though the signal correction arithmetic unit 32 has been explained as an example of the third embodiment, it is also applicable to the first embodiment. The same effect can be obtained by separately configuring the differentiators 61*a* and 61*b* for comparison which generate a differential signal for comparison, and the differentiators 62*a* and 62*b* for output which generate a final output signal.

Fifth Embodiment

Next, a fifth embodiment of the present invention is described.

In the second embodiment, a relative difference between the detection signals Ga and Gb of the gap sensors 7*a* and 7*b* is corrected by pre-processing. In contrast, in the fifth embodiment, the detection signals Ga and Gb are corrected based on the output signal Gc of the signal correction arithmetic unit 32 of any one of the first to fourth embodiments, and a final signal Gcc is generated from signals Gac and Gbc which are obtained by the correction.

A specific configuration of the fifth embodiment is described below.

Figure 16:
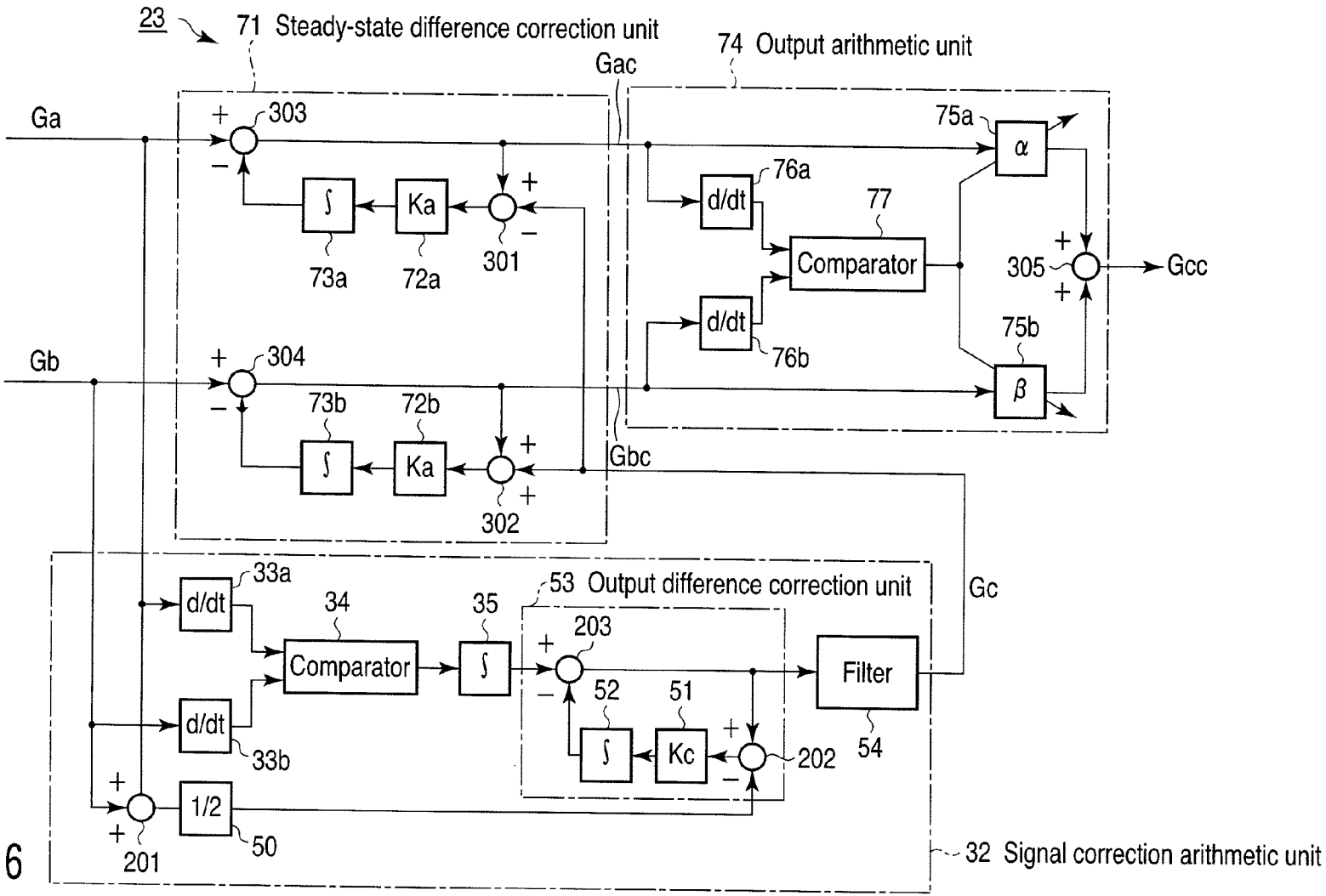
FIG. 16 is a block diagram showing a configuration of an arithmetic unit including a signal correction arithmetic unit according to a fifth embodiment of the present invention.

FIG. 16 is a block diagram showing a configuration of an arithmetic unit 23 including a signal correction/arithmetic unit 32 according to the fifth embodiment of the present invention. The same reference numbers are given to the same parts of the third embodiment shown in FIG. 14, and a description thereof is omitted. The structure of the magnetic guide unit 5 is the same as in the first embodiment.

In the fifth embodiments, the arithmetic unit 23 is provided with a steady-state difference correction unit 71 and an output arithmetic unit 74, in addition to the signal correction arithmetic unit 32. The signal correction arithmetic unit 32 receives the detection signals Ga and Gb output from the gap sensors 7*a* and 7*b*, as input signals, and generates a signal Gc by correcting disturbance in the detection signals Ga and Gb. As a signal correction arithmetic unit 32, a unit adopting the configuration of the third embodiment is used, for example, is used.

The steady-state difference correction unit 71 receives the detection signals Ga and Gb output from the gap sensors 7*a* and 7*b*, as input signals, and corrects a relative error between the detection signals Ga and Gb by using the output signal Gc of the signal correction arithmetic unit 32, as a reference signal.

The steady-state difference correction unit 71 comprises adder-subtracters 301 and 302, gain multipliers 72*a* and 72*b*, integrators 73*a* and 73*b*, and subtracters 303 and 304.

The subtracter 301 calculates a difference between the detection signal Ga and the output signal Gc of the signal correction arithmetic unit 32. The gain multiplier 72*a* multiplies the difference signal output from the subtracter 301, by a predetermined feedback gain Ka, and outputs the resultant signal to the integrator 73*a*. The integrator 73*a* integrates the output signal of the gain multiplier 72*a*, and outputs the resultant signal to the subtracter 303. The subtracter 303 calculates a difference between the detection signal Ga and the output signal of the integrator 73*a*, and outputs the resultant signal to the output arithmetic unit 74, as a corrected signal Gac.

The adder 302 calculates a difference between the detection signal Gb and the output signal Gc of the signal correction arithmetic unit 32. The gain multiplier 72*b* multiplies the difference signal output from the adder 302, by a predetermined feedback gain Ka, and outputs the resultant signal to the integrator 73*b*. The integrator 73*b* integrates the output signal output from the gain multiplier 72*b*, and outputs the resultant signal to the subtracter 304. The subtracter 304 calculates a difference between the detection signal Gb and the output signal of the integrator 73*b*, and outputs the resultant signal to the output arithmetic unit 74, as a corrected signal Gbc.

The output arithmetic unit 74 receives the signals Gac and Gbc output from the steady-state difference correction unit 71, as input signal, and generates a final signal Gcc for magnetic control by multiplying the input signals by a suitable coefficient. The output arithmetic unit 74 comprises weight coefficient arithmetic units 75*a* and 75*b*, differentiators 76*a* and 76*b*, a comparator 77, and an adder 305.

The differentiator 76*a* differentiates the signal Gac, which is a correction signal of the detection signal Ga. The differentiator 76*b* differentiates the signal Gbc, which is a correction signal of the other detection signal Gb. By differentiating the signals Gac and Gbc, the variation amounts of them are known.

As described above, it is actually impossible to fabricate a "differentiator" which exactly performs differential operations. Thus, in usual cases, a "inexact-differentiator" which cuts frequencies higher than a certain level is used. The term "differentiator" in this description includes such a "inexact-differentiator".

The comparator 77 compares the output signals of the differentiators 76*a* and 76*b*. The weight coefficient multiplier 75*a* multiplies the signal Gac by a weight coefficient α according to the result of comparison in the comparator 77. The weight coefficient multiplier 75*b* multiplies the signal Gbc by a weight coefficient β according to the result of comparison in the comparator 77. The adder 305 adds the detection signal Gac multiplied by the weight coefficient α, to the detection signal Gbc multiplied by the weight coefficient β, and outputs the added signal as a signal Gcc for magnetic control.

In the configuration described above, as explained in the third embodiment, in the signal correction arithmetic unit 32, the detection signals Ga and Gb output from the gap sensors 7*a* and 7*b* are differentiated by the differentiators 32*a* and 32*b*, and applied to the comparator 34. The comparator 34 compares the differential values of the input signals, and outputs one of the signals with a smaller absolute value. The signal output from the comparator 34 is applied to the integrator 35 and integrated there, and is sent to the output difference correction unit 53.

On the other hand, a signal obtained by averaging the detection signals Ga and Gb is generated by the ½ arithmetic unit 50 as a representative signal for signal correction, and the representative signal is applied to the output difference correction unit 53. The output difference correction unit 53 calculates a difference between the representative signal and the signal output from the integrator 35, and feeds back the difference signal to the output signal of the integrator 35 through the gain multiplier 51 and integrator 52. Thereby, the output signal of the integrator 35 is corrected by the representative signal obtained by averaging the detection signals Ga and Gb. And, the corrected signal is output as a signal Gc for magnetic control through the filter 54.

In the fifth embodiment, the signal Gc output from the signal correction arithmetic unit 32 is applied to the steady-state difference correction unit 71. The steady-state difference correction unit 71 uses this output signal Gc as a standard value, and corrects the detection signals Ga and Gb to be close to the output signal Gc. Thereby, a relative error between the detection signals Ga and Gb can be reduced, and the corrected signals Gac and Gbc with favorable response characteristics can be generated as corrected signals.

Subsequently, in the output arithmetic unit 74, the corrected signals Gac and Gbc are multiplied by the weight coefficients α and β. The weight coefficients α and β take values of 0 to 1, and are adjusted to have a sum of 1 according to the result of comparison in the comparator 77. In this case, a weight coefficient is increased for one of the signals with a smaller variation amount, and is decreased for the signal with a larger variation amount.

In this manner, the weight coefficients α and β are determined according to the variation amounts of the signals Gac and Gbc. After multiplying the signals Gac and Gbc by the weight coefficients α and β, the output arithmetic unit 74 generates a signal Gcc by adding these signals Gac and Gbc. The output signal Gcc is expressed by the following equation (1):

$$Gcc=(\alpha\times Gac)+(\beta\times Gbc)$$

$$\alpha+\beta=1, 0\leqq\alpha\leqq1, 0\leqq\beta\leqq1 \quad (1)$$

The output signal Gcc is one of the signals Gac and Gbc, in which the ratio of variation amount is increased.

Accordingly, by using the output signal Gcc as a signal for magnetic control, a stable one of the signals can be preferentially controlled, no matter which of the detection signals Gac and Gbc is disturbed.

In the case where the weight coefficients α and β, by which the detection signal Gac and Gbc are multiplied, are varied, the weight coefficient α and β should be continuously varied over a predetermined duration. Thereby, a sharp signal variation can be suppressed, and smooth control can be executed.

As described above, the output signal Gc of the signal correction arithmetic unit 32 is used as a standard value, a relative error between the detection signals Ga and Gb is corrected, and the corrected signals Gac and Gbc are added by multiplying them by the weight coefficients α and β according to the variation amounts. In this manner, the output signal Gcc with little disturbance is finally generated, and is delivered to the control device 21 as a signal for magnetic control. Therefore, even if the detection signal Ga and Gb are disturbed at the joint 2*c* of the guide rail 2, the car 4 is not unnecessarily shaken, stable magnetic control is always executed, and the car 4 can be run and guided in a noncontact manner.

Though the signal correction arithmetic unit 32 has been explained as an example of the third embodiment, the configuration disclosed in the other embodiments including the first embodiment may be used.

Though the output arithmetic unit 74 has been explained as a configuration in which a first-order differential value is calculated by the differentiators 76*a* and 76*b*, any other arithmetic unit may be used as long as it can calculate a value able to detect a variation amount of each signal, by using a second-order differential value or a value different from a signal before a predetermined duration, for example.

Sixth Embodiment

Next, a sixth embodiment of the present invention is described.

In the sixth embodiment, as in the fifth embodiment, the output signal Gc of the signal correction arithmetic unit 32 is used as a reference signal, and a final signal Gc for magnetic control is generated after a relative error between the detection signals Ga and Gb is corrected. At this time, unlike the fifth embodiment, the steady-state difference correction unit 71 is not used, and the output arithmetic unit 74 performs a correction process.

A specific configuration of the sixth embodiment is explained hereinafter.

Figure 17:
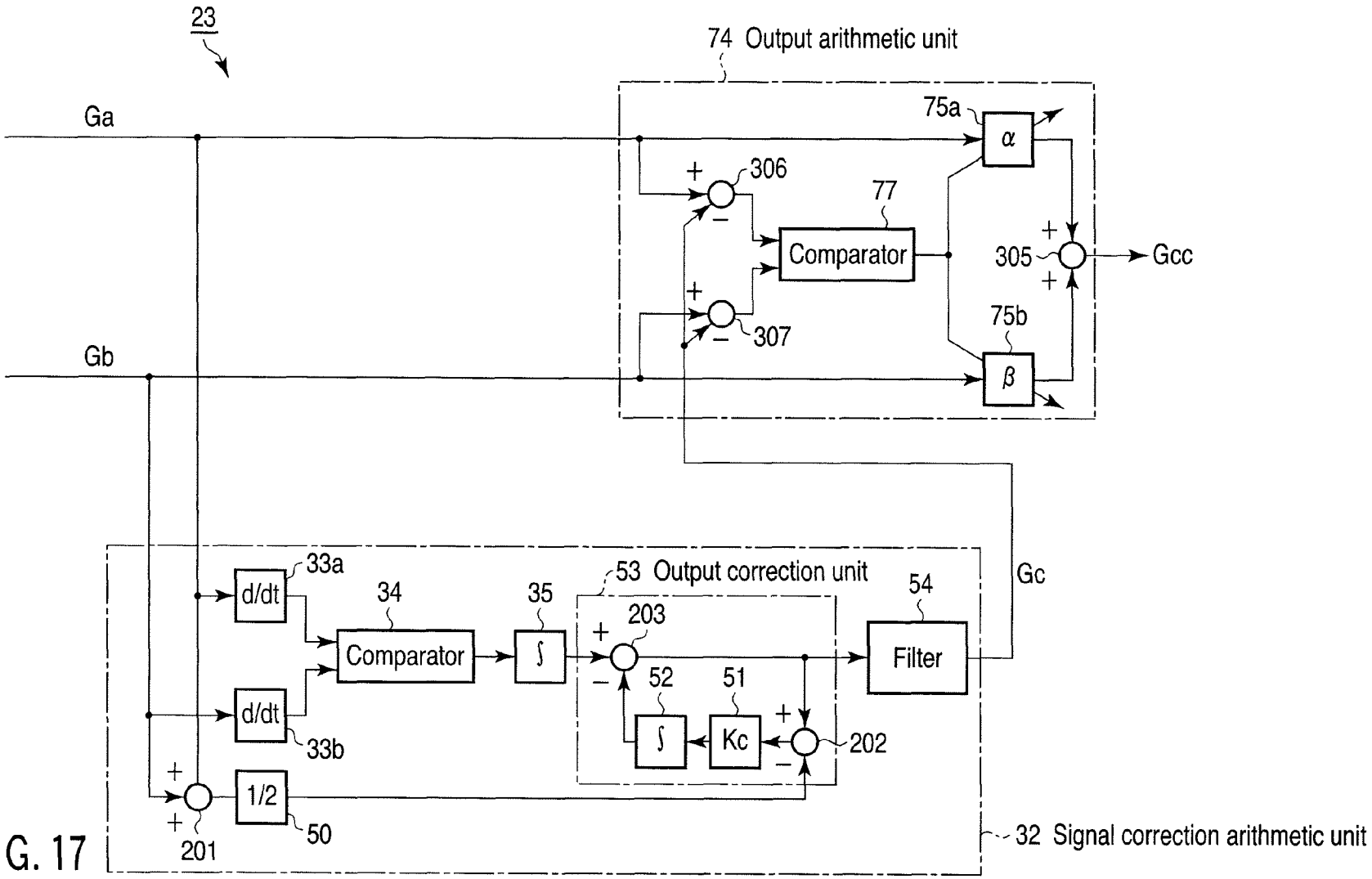
FIG. 17 is a block diagram showing a configuration of an arithmetic unit including a signal correction arithmetic unit according to a sixth embodiment of the present invention.

FIG. 17 is a block diagram showing a configuration of an arithmetic unit 23 including a signal correction arithmetic unit 32 according to the sixth embodiment of the invention. The same reference numbers are given to the same parts as in the third embodiment shown in FIG. 14, and a description thereof is omitted here. The structure of the magnetic guide unit 5 is the same as in the first embodiment.

In the sixth embodiment, the arithmetic unit 23 is provided with an output arithmetic unit 74, in addition to the signal correction arithmetic unit 32. The signal correction arithmetic unit 32 receives the detection signals Ga and Gb output from the gap sensors 7*a* and 7*b* as input signals, and generates a signal Gc by correcting disturbance of the detection signals Ga and Gb. As a signal correction arithmetic unit 32, a unit adopting the configuration of the third embodiment, for example, is used.

The output arithmetic unit 74 receives the detection signals Ga and Gbc as input signals, and generates a final signal Gcc for magnetic control by multiplying these input signals by a suitable coefficient. Unlike the fifth embodiment, the output arithmetic unit 74 is provided with subtracters 306 and 307 instead of the differentiators 76*a* and 76*b*.

The subtracter 306 calculates a difference between the detection signal Ga and the output signal Gc of the signal correction arithmetic unit 32, and outputs the difference signal to the comparator 77. The subtracter 307 calculates a difference between the detection signal Gb and the output signal Gc of the signal correction arithmetic unit 32, and outputs the difference signal to the comparator 77. The comparator 77 compares the difference values of the both inputs, and adjusts the weight coefficient arithmetic units 75*a* and 75*b* to increase the weight coefficient to be applied to one of the signals with a smaller absolute value of the difference value.

In the above configuration, as explained in the third embodiment, in the signal correction arithmetic unit 32, the detection signals Ga and Gb output from the gap sensors 7*a* and 7*b* are differentiated by the differentiators 32*a* and 32*b*, and applied to the comparator 34. The comparator 34 compares the differential values of the input signals, and outputs one of the signals with a smaller absolute value. The signal output from the comparator 34 is applied to the integrator 35 and integrated there, and is applied to the output difference correction unit 53.

On the other hand, the ½ arithmetic unit 50 generates a representative signal for signal correction by averaging the detection signals Ga and Gb, and the representative signal is applied to the output difference correction unit 53. The output difference correction unit 53 calculates a difference between the representative signal and the signal output from the integrator 35, and feeds back the difference signal to the output signal of the integrator 35 through the gain multiplier 51 and integrator 52. Thereby, the output signal of the integrator 35 is corrected by the representative signal obtained by averaging the detection signals Ga and Gb. And, the corrected signal is output as a signal Gc for magnetic control through the filter 54.

In the sixth embodiment, the signal Gc output from the signal correction arithmetic unit 32 is applied to the subtracters 306 and 307 provided in the output arithmetic unit 74. In the fifth embodiment, the output signal Gc of the signal correction arithmetic unit 32 is used for correcting the detection signals Ga and Gb, but in the sixth embodiment, the output signal Gc is used for comparing the detection signals Ga and Gb.

The comparator 77 compares the difference values obtained from the subtracters 306 and 307, and adjusts the values of the weight coefficients $\alpha$ and $\beta$ in a range of 0 to 1, to increase the weight of one of the signals with a smaller absolute value. The sum of the weight coefficients $\alpha$ and $\beta$ is 1.

In this manner, the weight coefficients $\alpha$ and $\beta$ are determined according to the difference amounts between the signals Ga and Gb and the output signal Gc. The output arithmetic unit 74 multiplies the signals Ga and Gb by the weight coefficients $\alpha$ and $\beta$, and generates a signal Gcc by adding these signal values.

The output signal Gcc is one of the signals Ga and Gb, in which the ratio closer to the signal Gc is increased. Accordingly, by using the output signal Gcc as a signal for magnetic control, stable control can be always executed, no matter which of the detection signals Ga and Gb is disturbed.

In the case where the weight coefficients $\alpha$ and $\beta$, by which the detection signal Gac and Gbc are multiplied, is varied, the weight coefficient $\alpha$ and $\beta$ should be continuously varied over a predetermined duration. Thereby, a sharp signal variation can be suppressed, and smooth control can be executed.

As described above, in the sixth embodiment, as in the fifth embodiment, the output signal Gcc with little disturbance is finally generated, and is delivered to the control device 21 as a signal for magnetic control. Therefore, even if the detection signal Ga and Gb are disturbed at the joint 2*c* of the guide rail 2, the car 4 is not unnecessarily shaken, stable magnetic control is always executed, and the car 4 can be run and guided in a noncontact manner.

Besides, in the fifth embodiment, the detection signals Ga and Gb are previously corrected in the steady-state difference correction unit 71, and a smooth signal can be obtained. However, the signal is likely to be delayed by the correction operation in the steady-state difference correction unit 71. On the other hand, in the sixth embodiment, the output signal Gc of the signal correction arithmetic unit 32 is input to the output arithmetic unit 74, and the signal Gcc for magnetic control is generated. Therefore, the signal is not delayed by a correction operation.

Though the signal correction arithmetic unit 32 has been explained as an example of the third embodiment, the configuration disclosed in the other embodiments including the first embodiment may be used.

Seventh Embodiment

Next, a seventh embodiment of the present invention is described.

In the sixth embodiment, a direct difference between the detection signals Ga and Gb and the output signal Gc of the signal correction arithmetic unit 32 is calculated. On the other hand, in the seventh embodiment, a difference is calculated after these signals are differentiated.

A specific configuration of the seventh embodiment is explained hereinafter.

Figure 18:
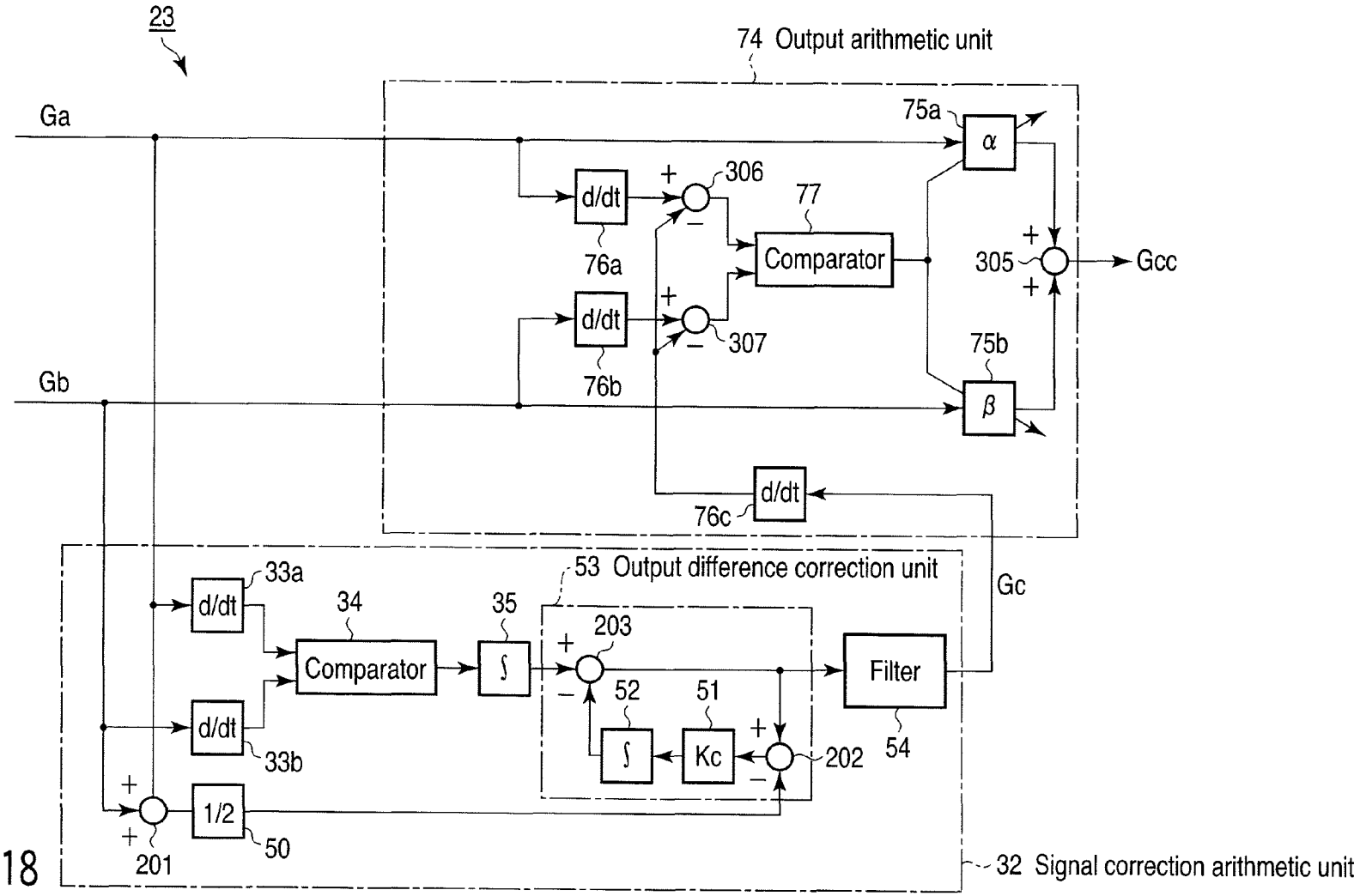
FIG. 18 is a block diagram showing a configuration of an arithmetic unit including a signal correction arithmetic unit according to a seventh embodiment of the present invention.

FIG. 18 is a block diagram showing a configuration of an arithmetic unit 23 including a signal correction arithmetic unit 32 according to the seventh embodiment of the invention. The same reference numbers are given to the same parts in the third embodiment shown in FIG. 14, and a description thereof is omitted here. The structure of the magnetic guide unit 5 is the same as in the first embodiment.

In the seventh embodiment, the arithmetic unit 23 is provided with an output arithmetic unit 74, in addition to the signal correction arithmetic unit 32. The signal correction arithmetic unit 32 receives the detection signals Ga and Gb output from the gap sensors 7*a* and 7*b* as input signals, and generates a signal Gc by correcting disturbance of the detection signals Ga and Gb. As a signal correction arithmetic unit 32, a unit adopting the configuration of the third embodiment, for example, is used.

The output arithmetic unit 74 receives the detection signals Ga and Gb as input signals, and generates a final signal Gcc for magnetic control by multiplying these input signals by a suitable coefficient. In the output arithmetic unit 74, differentiators 76*a*, 76*b* and 76*c* are added to the sixth embodiment.

Namely, the differentiator 76*a* differentiates the detection signal Ga, and outputs the differential signal to the subtracter 306. The differentiator 76*b* differentiates the other detection signal Gb, and outputs the differential signal to the subtracter 307. The subtracters 306 and 307 receive the output signal Gc of the signal correction arithmetic unit 32 through the differentiator 76*c*. Thereby, the subtracter 306 calculates a difference between the difference signal of the detection signal Ga and the difference signal of the output signal Gc of the signal correction arithmetic unit 32, and outputs the difference to the comparator 77.

The subtracter 307 calculates a difference between the difference signal of the detection signal Gb and the difference signal of the output signal Gc of the signal correction arithmetic unit 32, and outputs the difference to the comparator 77. The comparator 77 compares the difference values of the both inputs, and adjusts the weight coefficient arithmetic units 75*a* and 75*b* to increase the weight coefficient to be applied to one of the signals with a smaller absolute value of the difference value.

In the above configuration, as explained in the third embodiment, in the signal correction arithmetic unit 32, the detection signals Ga and Gb output from the gap sensors 7*a* and 7*b* are differentiated by the differentiators 33*a* and 33*b*, and applied to the comparator 34. The comparator 34 compares the differential values of the input signals, and outputs one of the signals with a smaller absolute value. The signal output from the comparator 34 is applied to the integrator 35 and integrated there, and is applied to the output difference correction unit 53.

On the other hand, the ½ arithmetic unit 50 generates a representative signal for signal correction by averaging the detection signals Ga and Gb, and the representative signal is applied to the output difference correction unit 53. The output difference correction unit 53 calculates a difference between the representative signal and the signal output from the integrator 35, and feeds back the difference signal to the output signal of the integrator 35 through the gain multiplier 51 and integrator 52. Thereby, the output signal of the integrator 35 is corrected by the representative signal obtained by averaging the detection signals Ga and Gb. And, the corrected signal is output as a signal Gc for magnetic control through the filter 54.

In the seventh embodiment, the signal Gc output from the signal correction arithmetic unit 32 is differentiated through the differentiator 76*c*, and applied to the subtracters 306 and 307 provided in the output arithmetic unit 74. On the other hand, the detection signal Ga is differentiated by the differentiator 76*a*, and applied to the subtracter 306. The detection signal Gb is differentiated by the differentiator 76*b*, and applied to the subtracter 307.

The subtracters 306 and 307 calculate a difference between the input differential signals, and applies the result to the comparator 77. Thereby, The comparator 77 compares the difference values obtained from the subtracters 306 and 307, and adjusts the values of the weight coefficients $\alpha$ and $\beta$ in a range of 0 to 1, to increase the weight of one of the signals with a smaller absolute value. The sum of the weight coefficients $\alpha$ and $\beta$ is 1.

In this manner, the weight coefficients $\alpha$ and $\beta$ are determined according to the difference amounts between the differential values of the signals Ga and Gb and the differential value of the output signal Gc. The output arithmetic unit 74 multiplies the signals Ga and Gb by the weight coefficients $\alpha$ and $\beta$, and generates a signal Gcc by adding these signal values.

The output signal Gcc is one of the signals in which the ratio closer to the signal Gc is increased.

Accordingly, by using the output signal Gcc as a signal for magnetic control, stable control can be always executed, no matter which of the detection signals Ga and Gb is disturbed.

In the case where the weight coefficients $\alpha$ and $\beta$, by which the detection signal Gac and Gbc are multiplied, are varied, the weight coefficient $\alpha$ and $\beta$ should be continuously varied over a predetermined duration. Thereby, a sharp signal variation can be suppressed, and smooth control can be executed.

As described above, also by comparing the results of differentiation of the detection signals Ga and Gb and the output signal Gc of the signal correction arithmetic unit 32, the output signal Gcc with little disturbance is finally generated, and is delivered to the control device 21 as a signal for magnetic control, as in the sixth embodiment. Therefore, even if the detection signal Ga and Gb are disturbed at the joint 2*c* of the guide rail 2, the car 4 is not unnecessarily shaken, stable magnetic control is always executed, and the car 4 can be run and guided in a noncontact manner.

In this case, by differentiating the signals Ga, Gb, and Gc, the comparing is possible in a state in which an offset amount is eliminated, and a difference among these signals can be exactly obtained. As a result, it is possible to generate a more accurate signal Gcc for magnetic control.

Though the signal correction arithmetic unit 32 has been explained as an example of the third embodiment, the configuration disclosed in the other embodiments including the first embodiment may be used.

In the embodiments described herein, signal processing of gap sensors provided in one direction for detection has been described. The same is applied to signal processing of the gap sensors (7*c* and 7*d* in FIG. 2) provided in another direction for detection.

In each of the above-described embodiments, a method of signal processing of gap sensors has been described by exemplifying a magnetic guide apparatus provided in a car of an elevator. However, the magnetic guide apparatus of the present invention can be applied not only to an elevator, but also to all kinds of moving body, which are supported in a noncontact manner by a magnetic force. In this case, by executing the same signal processing as described herein, unnecessary disturbance, which is superimposed on the detection signals of the gap sensors, can be reduced, and smooth running and guiding can be realized.

In summary, the present invention is not limited directly to the embodiments described herein. In practice, the structural elements can be modified and embodied without departing from the spirit of the invention. The invention may be embodied in other various forms by properly combining the structural elements disclosed in the embodiments. For example, some structural elements may be omitted from the elements disclosed in the embodiments. Further, structural elements may be appropriately combined in different embodiments.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A magnetic guide apparatus comprising:

a guide rail formed of a ferromagnetic body;

a moving body which moves along the guide rail;

a magnet unit which is disposed on a part of the moving body, which is opposed to the guide rail, and supports the moving body by a magnetic force in a state not in contact with the guide rail;

at least two gap sensors which are disposed with a predetermined interval in a direction of movement of the moving body, and detect a gap between the magnet unit and the guide rail;

a signal correction arithmetic unit which differentiates detection signals output from the gap sensors, integrates a differential signal with a smallest absolute value, and outputs the signal for magnetic control; and a control device which controls the magnetic force of the magnet unit based on the signal for magnetic control, which is output from the signal correction arithmetic unit.

2. The magnetic guide apparatus according to claim 1, wherein the signal correction arithmetic unit has a representative signal generation unit which generates a representative signal for signal correction from the detection signals of the gap sensors; and an output difference correction unit which corrects a signal obtained by integrating the differential signal, based on the representative signal generated by the representative signal generation unit, and the signal correction arithmetic unit outputs a signal corrected by the output difference correction unit as a signal for magnetic control.

3. The magnetic guide apparatus according to claim 2, wherein the representative signal generation unit generates a signal, which is obtained by averaging the detection signals from the gap sensors, as a representative signal for signal correction.

4. The magnetic guide apparatus according to claim 1, wherein a steady-state difference correction unit for correcting a relative difference between the detection signals from the gap sensors is provided in a stage preceding to the signal correction arithmetic unit, and the detection signals corrected by the steady-state difference correction unit are input to the signal correction arithmetic unit.

5. The magnetic guide apparatus according to claim 2, wherein a steady-state difference correction unit for correcting a relative difference between the detection signals from the gap sensors is provided in a stage preceding to the signal correction arithmetic unit, and the detection signals corrected by the steady-state difference correction unit are input to the signal correction arithmetic unit.

6. The magnetic guide apparatus according to claim 1, wherein the signal correction arithmetic unit has first differentiators which differentiate the detection signals from the gap sensors; and second differentiators which have characteristics capable of differentiating a signal with frequency higher than the first differentiators, and differentiate the detection signals from the gap sensors, separately from the first differentiators, and the signal correction arithmetic unit uses a differential signal obtained by the first differentiators for comparison, and integrates a differential signal obtained by the second differentiators based on the result of comparison.

7. The magnetic guide apparatus according to claim 1, further comprising:

a steady-state difference correction unit which uses an output signal of the signal correction arithmetic unit as a reference signal, and corrects a relative error between the detection signals from the gap sensors based on the reference signal; and an output arithmetic unit which detects a variation amount of each detection signal corrected by the steady-state difference correction unit, relatively varies a weight coefficient in accordance with the variation amount, and finally outputs a signal, which is obtained by adding the detection signals multiplied by the weight coefficient, as a signal for magnetic control.

8. The magnetic guide apparatus according to claim 1, further comprising an output arithmetic unit which uses the output signal of the signal correction arithmetic unit as a reference signal, detects an error between the reference signal and the detection signals from the gap sensors, varies a weight coefficient relatively in accordance with the error, and finally outputs a signal, which is obtained by adding the detection signals multiplied by the weight coefficient, as a signal for magnetic control.

9. The magnetic guide apparatus according to claim 1, further comprising an output arithmetic unit which uses the output signal of the signal correction arithmetic unit as a reference signal, detects an error between the reference signal and the detection signals from the gap sensors, in a state in which the reference signal and the detection signals from the gap sensors are differentiated, varies a weight coefficient relatively in accordance with the error, and finally outputs a signal, which is obtained by adding the detection signals multiplied by the weight coefficient, as a signal for magnetic control.

10. The magnetic guide apparatus according to claim 1, wherein the signal correction arithmetic unit has a filter for correcting a phase delay of a signal obtained by integrating the differential signal.

* * * * *